US009790013B2

(12) United States Patent
Loftin et al.

(10) Patent No.: US 9,790,013 B2
(45) Date of Patent: Oct. 17, 2017

(54) DISPENSING SYSTEM AND PACKAGE FOR USE THEREWITH

(75) Inventors: Caleb S. Loftin, Richmond, VA (US); Aaron L. Bates, Kennesaw, GA (US); Laurel Thomas, Portland, OR (US); Derek King, Northamptonshire (GB); John A. Gelardi, Midlothian, VA (US)

(73) Assignee: WestRock MWV, LLC, Norcross, GA (US)

( * ) Notice: Subject to any disclaimer, the term of this patent is extended or adjusted under 35 U.S.C. 154(b) by 387 days.

(21) Appl. No.: 13/508,380

(22) PCT Filed: Nov. 12, 2010

(86) PCT No.: PCT/US2010/056465

§ 371 (c)(1),
(2), (4) Date: May 7, 2012

(87) PCT Pub. No.: WO2011/062839

PCT Pub. Date: May 26, 2011

(65) Prior Publication Data

US 2012/0228247 A1 Sep. 13, 2012

Related U.S. Application Data

(63) Continuation of application No. 12/777,444, filed on May 11, 2010, now Pat. No. 7,922,437.

(Continued)

(51) Int. Cl.

*A47F 1/04* (2006.01)
*B65D 71/36* (2006.01)

(Continued)

(52) U.S. Cl.

CPC ..... *B65D 71/36* (2013.01); *A47F 1/087* (2013.01); *B65D 5/5206* (2013.01); *B65D 5/725* (2013.01);

(Continued)

(58) Field of Classification Search

CPC ..... A47F 1/087; B65D 5/5206; B65D 5/725; B65D 25/24; B65D 2571/00141;

(Continued)

(56) References Cited

U.S. PATENT DOCUMENTS 902,347 A 10/1908 Tillinghast
1,291,420 A 1/1919 Cough (Continued)

FOREIGN PATENT DOCUMENTS

AT 6036 U1 3/2003
DE 2655496 6/1978

(Continued)

*Primary Examiner* — Korie H Chan

(74) *Attorney, Agent, or Firm* — WestRock IP Legal

(57) ABSTRACT

A system for dispensing articles provided initially in a package is disclosed that comprises a frame configured to support the package of articles and a package-opening tool associated with the frame. The frame includes longitudinally opposed front and rear end sections, and an upper support deck extending at least partially between the front and rear end sections and below which a product display area is provided. The opening tool associated with the frame such that its open the package when the package is moved longitudinally on the upper support deck and relative to the opening tool, thereby allowing the articles to be at least partially dispensed from the package into the product display area.

20 Claims, 32 Drawing Sheets

Related U.S. Application Data

(60) Provisional application No. 61/263,767, filed on Nov. 23, 2009.

(51) Int. Cl.

| | |
|---|---|
| ***A47F 1/08*** | (2006.01) |
| ***B65D 5/52*** | (2006.01) |
| ***B65D 5/72*** | (2006.01) |
| ***B65D 25/24*** | (2006.01) |
| ***G07F 11/32*** | (2006.01) |

(52) U.S. Cl.

CPC ..... *B65D 25/24* (2013.01); *G07F 11/32* (2013.01); *B65D 2571/0066* (2013.01); *B65D 2571/00141* (2013.01); *B65D 2571/00617* (2013.01); *B65D 2571/00728* (2013.01); *Y10S 83/946* (2013.01); *Y10T 83/9493* (2015.04)

(58) Field of Classification Search

CPC .. B65D 2571/00617; B65D 2571/0066; B65D 2571/00728; B65D 71/36; G07F 11/32; Y10S 83/946; Y10T 83/9493

USPC ..... 211/59.2; 221/285, 68; 414/412; 229/122.2, 204; 83/856, 946

See application file for complete search history.

(56) References Cited

U.S. PATENT DOCUMENTS

| | | | |
|---|---|---|---|
| 1,383,318 | A | 7/1921 | McCormick |
| 1,393,964 | A | 10/1921 | Potts et al. |
| 1,487,130 | A | 3/1924 | Witherell |
| 1,753,957 | A | 4/1930 | Washburn |
| 1,824,937 | A | 9/1931 | Trouth |
| 1,858,199 | A | 5/1932 | Maziroff |
| 1,898,056 | A | 2/1933 | Johnson |
| 1,919,907 | A | 7/1933 | Robinson |
| 1,932,225 | A | 10/1933 | Minter |
| 1,941,458 | A | 2/1934 | Bens |
| 1,985,739 | A | 12/1934 | Murray |
| 2,078,599 | A | 4/1937 | McCauley |
| 2,110,194 | A | 3/1938 | Blier |
| 2,263,353 | A | 11/1941 | Eidam |
| 2,291,187 | A | 7/1942 | Johnson |
| 2,382,191 | A | 7/1944 | Weichselbaum |
| 2,536,421 | A | 2/1951 | Burhans |
| 2,573,381 | A | 10/1951 | Arnold |
| 2,574,087 | A | 11/1951 | Burhans |
| 2,595,122 | A | 4/1952 | Burhans |
| 2,732,619 | A | 1/1956 | Labine |
| 2,784,871 | A | 3/1957 | Gabrielsen |
| 2,795,845 | A | 6/1957 | Shimer |
| 2,818,978 | A | 1/1958 | Post |
| 2,826,471 | A | 3/1958 | Fonda |
| 2,831,591 | A | 4/1958 | Morton |
| 2,888,145 | A | 5/1959 | Knott et al. |
| 2,915,932 | A | 12/1959 | Gross |
| 2,919,488 | A | 1/1960 | Brownlee |
| 2,996,344 | A | 8/1961 | Garman |
| 3,018,149 | A | 1/1962 | Parker |
| 3,055,293 | A | 9/1962 | Lariccia |
| 3,066,827 | A | 12/1962 | Pryor |
| 3,137,068 | A | 6/1964 | Quigley |
| D198,888 | S | 8/1964 | Heselov |
| 3,178,242 | A | 4/1965 | Ellis et al. |
| 3,184,104 | A | 5/1965 | De Domenico et al. |
| 3,203,554 | A | 8/1965 | Pendergrast et al. |
| 3,204,335 | A | 9/1965 | Hughes |
| 3,288,544 | A | 11/1966 | Knecht |
| 3,300,115 | A | 1/1967 | Schauer |
| 3,304,141 | A | 2/1967 | Rogers |
| 3,318,455 | A | 5/1967 | Takahashi |
| 3,335,940 | A | 8/1967 | Dykes |
| 3,340,790 | A | 9/1967 | Simjian |
| 3,348,738 | A | 10/1967 | Hertlein |
| 3,392,901 | A | 7/1968 | Krzyzanowski |
| 3,393,808 | A | 7/1968 | Chirchill |
| 3,501,016 | A | 3/1970 | Eaton |
| 3,763,557 | A | 10/1973 | Sewell |
| 3,784,022 | A | 1/1974 | Beesley, Jr. |
| 3,922,778 | A | 12/1975 | Aalpoel |
| 3,923,159 | A | 12/1975 | Taylor et al. |
| 3,972,454 | A | 8/1976 | Croley |
| 4,105,126 | A | 8/1978 | Deffner et al. |
| 4,205,440 | A | 6/1980 | Morgan |
| 4,260,072 | A | 4/1981 | Quasarano |
| 4,318,458 | A | 3/1982 | Ritsema |
| 4,382,526 | A | 5/1983 | Stone |
| 4,396,143 | A | 8/1983 | Killy |
| 4,435,026 | A | 3/1984 | Johnson |
| 4,467,524 | A | 8/1984 | Ruff et al. |
| 4,576,272 | A | 3/1986 | Morgan, Jr. |
| 4,598,828 | A | 7/1986 | Young et al. |
| 4,729,480 | A | 3/1988 | Groover et al. |
| 4,744,489 | A | 5/1988 | Binder et al. |
| 4,834,263 | A | 5/1989 | Becze |
| 4,869,395 | A | 9/1989 | Rubbmark |
| 4,911,309 | A | 3/1990 | Stefan |
| 4,915,571 | A | 4/1990 | Toshihiko et al. |
| 4,923,070 | A | 5/1990 | Jackle et al. |
| 4,997,106 | A | 3/1991 | Rockola |
| 4,998,628 | A | 3/1991 | Ross |
| 5,033,348 | A | 7/1991 | Walsh |
| 5,080,256 | A | 1/1992 | Rockola |
| 5,101,703 | A | 4/1992 | Tanaka et al. |
| 5,167,345 | A | 12/1992 | Bleeker |
| 5,190,155 | A | 3/1993 | Grunwald |
| 5,251,972 | A | 10/1993 | Zurawin |
| 5,289,943 | A | 3/1994 | Powell |
| 5,314,078 | A | 5/1994 | Morikiyo et al. |
| 5,328,258 | A | 7/1994 | Scalise |
| 5,356,033 | A | 10/1994 | Delaney |
| 5,372,278 | A | 12/1994 | Leight |
| 5,390,821 | A | 2/1995 | Markel |
| 5,396,997 | A | 3/1995 | Johnson |
| D363,174 | S | 10/1995 | Fletcher, Sr. |
| 5,462,198 | A | 10/1995 | Schwimmer |
| 5,529,207 | A | 6/1996 | Oden et al. |
| 5,638,988 | A | 6/1997 | Rogers |
| 5,685,664 | A | 11/1997 | Parham et al. |
| 5,740,610 | A | 4/1998 | Ayer et al. |
| 5,788,117 | A | 8/1998 | Zimmanck |
| 5,791,048 | A | 8/1998 | Bodnar et al. |
| 5,836,478 | A | 11/1998 | Weiss |
| 5,878,862 | A | 3/1999 | Dewsnap |
| 5,894,942 | A | 4/1999 | Miyashita et al. |
| 5,924,573 | A | 7/1999 | Piraneo et al. |
| 5,992,286 | A | 11/1999 | Boole |
| 5,992,652 | A | 11/1999 | Springs |
| 6,186,345 | B1 | 2/2001 | Robertson |
| 6,199,720 | B1 | 3/2001 | Rudick et al. |
| 6,206,237 | B1 | 3/2001 | Dillon et al. |
| 6,253,930 | B1 | 7/2001 | Freidus et al. |
| 6,267,258 | B1 | 7/2001 | Wilkerson et al. |
| 6,393,799 | B2 | 5/2002 | Jenkins et al. |
| 6,453,641 | B1 | 9/2002 | Puckett |
| 6,637,604 | B1 | 10/2003 | Jay |
| 6,802,433 | B2 | 10/2004 | Leykin et al. |
| 6,991,116 | B2 | 1/2006 | Johnson et al. |
| 7,207,447 | B2 | 4/2007 | Medcalf et al. |
| 7,303,095 | B2 | 12/2007 | Nagelski et al. |
| 7,546,973 | B2 | 6/2009 | Budz et al. |
| 7,584,854 | B2 | 9/2009 | Chandaria |
| D604,972 | S | 12/2009 | Henry et al. |
| 7,665,618 | B2 | 2/2010 | Jay et al. |
| 7,681,745 | B2 | 3/2010 | Richter |
| 7,757,890 | B2 | 7/2010 | Alford et al. |
| 7,810,672 | B1 | 10/2010 | Mason et al. |
| 7,823,733 | B2 | 11/2010 | Futori |
| 7,850,015 | B1 | 12/2010 | Mason |
| 7,913,860 | B2 | 3/2011 | Merl |
| 7,918,365 | B2 | 4/2011 | White et al. |
| 7,922,437 | B1 | 4/2011 | Loftin et al. |

(56) References Cited

U.S. PATENT DOCUMENTS

| | | | |
|---|---|---|---|
| 7,992,747 | B2 | 8/2011 | Bauer |
| 8,028,855 | B2 | 10/2011 | White et al. |
| 2002/0043509 | A1 | 4/2002 | Lajeunesse et al. |
| 2003/0173322 | A1 | 9/2003 | Rushing |
| 2004/0011751 | A1 | 1/2004 | Johnson et al. |
| 2004/0079760 | A1 | 4/2004 | Rink |
| 2004/0262326 | A1 | 12/2004 | Christensen |
| 2005/0092644 | A1 | 5/2005 | Cafferata |
| 2005/0127015 | A1 | 6/2005 | Medcalf et al. |
| 2005/0207877 | A1 | 9/2005 | Haverdink |
| 2006/0081692 | A1 | 4/2006 | Stewart et al. |
| 2006/0237384 | A1 | 10/2006 | Neumann et al. |
| 2006/0243683 | A1 | 11/2006 | Onachilla et al. |
| 2006/0278591 | A1 | 12/2006 | Tippets et al. |
| 2007/0194037 | A1 | 8/2007 | Close |
| 2008/0245813 | A1 | 10/2008 | Johnson et al. |
| 2009/0212066 | A1 | 8/2009 | Bauer |
| 2009/0266776 | A1 | 10/2009 | Johnson |
| 2009/0277853 | A1 | 11/2009 | Bauer |
| 2009/0308885 | A1 | 12/2009 | Sainato et al. |
| 2010/0032391 | A1 | 2/2010 | Schneider et al. |
| 2011/0121010 | A1 | 5/2011 | Loftin et al. |
| 2011/0121011 | A1 | 5/2011 | Gelardi et al. |

FOREIGN PATENT DOCUMENTS

| | | | |
|---|---|---|---|
| DE | 29808673 | | 11/1998 |
| DE | 19808162 | | 9/1999 |
| DE | 20111307 | | 10/2001 |
| DE | 202007012114 | | 11/2007 |
| FR | 2 415 051 | A1 | 8/1979 |
| GB | 2190906 | | 12/1978 |
| GB | 2303624 | | 2/1997 |
| JP | 03105494 | A | 5/1991 |
| JP | 03133737 | A | 6/1991 |
| JP | 03198192 | A | 8/1991 |
| JP | 03273469 | A | 12/1991 |
| JP | 03273470 | A | 12/1991 |
| JP | 03273471 | A | 12/1991 |
| JP | 03273472 | A * | 12/1991 |
| JP | 03273472 | A | 12/1991 |
| JP | 03273474 | A | 12/1991 |
| JP | 03273476 | A | 12/1991 |
| JP | 03273477 | A | 12/1991 |
| JP | 03273480 | A | 12/1991 |
| JP | 03273482 | A | 12/1991 |
| JP | 03273483 | A | 12/1991 |
| JP | 04086985 | A | 3/1992 |
| JP | 04115392 | A | 4/1992 |
| JP | 04137194 | A | 5/1992 |
| JP | 05004640 | A | 1/1993 |
| JP | 05174239 | A | 7/1993 |
| JP | 05346984 | A | 12/1993 |
| JP | 08161611 | A | 6/1996 |
| JP | 09027066 | A | 1/1997 |
| JP | 09102065 | A | 4/1997 |
| JP | 09282537 | A | 10/1997 |
| JP | 09311971 | A | 12/1997 |
| JP | 10269421 | A | 10/1998 |
| JP | 11011471 | A | 1/1999 |
| JP | 11171264 | A | 6/1999 |
| JP | 11191175 | A | 7/1999 |
| JP | 11328513 | A | 11/1999 |
| JP | 2001072076 | A | 3/2001 |
| JP | 2001206358 | A | 7/2001 |
| JP | 2003327243 | A | 11/2003 |
| JP | 2004017970 | A | 1/2004 |
| JP | 2005338910 | A | 12/2005 |
| JP | 04157593 | B1 | 10/2008 |
| WO | WO 9106076 | | 5/1991 |
| WO | WO 9321074 | | 10/1993 |
| WO | WO 9423619 | | 10/1994 |
| WO | WO 0054632 | | 9/2000 |
| WO | WO 2004014755 | | 2/2004 |
| WO | WO 2004113808 | | 12/2004 |
| WO | WO 2009138538 | | 11/2009 |
| WO | WO 2011025483 | | 3/2011 |
| WO | WO 2011109350 | | 9/2011 |

* cited by examiner

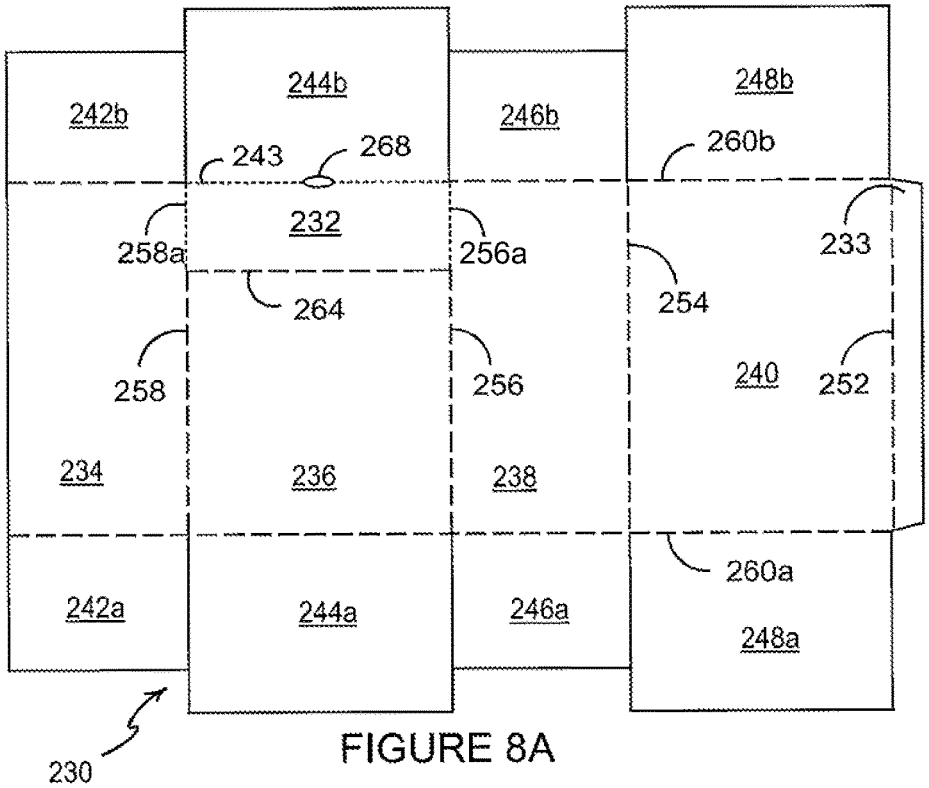
FIGURE 8A
FIGURE 8B
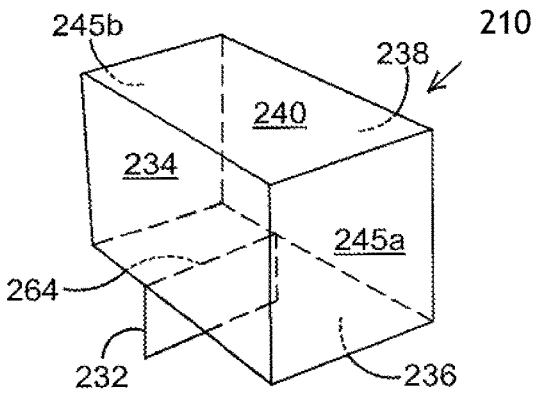
FIGURE 8C
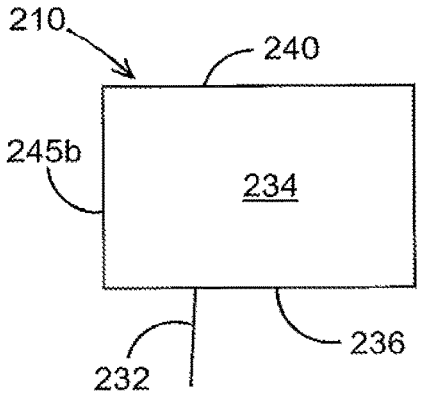

DISPENSING SYSTEM AND PACKAGE FOR USE THEREWITH

BACKGROUND OF THE DISCLOSURE

At point-of-sale (P.O.S.) or display units in retail outlets, it is convenient to present articles and products in an eye-catching and easily accessible manner. Furthermore, these point-of-sale or display units act as a storage area for articles and products. Thus, it is necessary to maximize the amount of storage space utilised, while at the same time enabling a customer to easily select and take products away for purchase. To achieve this, as articles are removed, it is desirable for the shelf to present the next stored article being forwardly filled for easy selection by a customer. Some dispensers have sprung-biased mechanisms that push articles forward. Some other known display devices use gravity feed mechanisms to cause articles to flow to the forward-most sale position.

U.S. Pat. No. 5,396,997 discloses a dispensing device having upper and lower jar guides with a plurality of glass jar containers loaded on their sides through a container loading area. The dispenser racks successively feed one container at a time to the container dispensing area to thereby provide a self-feeding and self-facing storage, dispensing and display system. One drawback of such system is that loading of the dispensing device must be done manually and individually. A rotatable door panel is provided so that loading occurs through the openable upper jar guide. Accordingly, in such system the articles are fed one at a time into the upper jar guide. Loading in this manner can be slow. Additionally, the products being displayed in the dispensing device are usually transported to a retail outlet in a carton or box containing a number of such articles. If the dispensing device is not capable of holding all of the articles contained in the delivered carton or box, then any articles that could not be loaded into the dispensing device need to be stored elsewhere in the retail out-let in the part emptied carton or box until such time as the dispensing device can accommodate those articles.

It is therefore desirable to improve the manner in which the filling of the dispensing devices takes place. It is desirable that the filling is quick, enables full cartons of delivered goods to be accommodated in the dispensing device. Moreover, it is desirable that the requirement for storing any extra articles that cannot be displayed is avoided. Further, it is beneficial that such dispensing devices are made from a minimum amount of material. The dispensing devices should also be as eye-catching as possible to the customer and contain branding, advertising and/or marketing material for this purpose. Since the advertising and branding materials and graphics are frequently changed and altered in line with trends and promotions, it is desirable that the dispensing devices are adaptable to facilitate quick changeovers in the branding, advertising and marketing graphics displayed thereon.

SUMMARY OF THE DISCLOSURE

A system for dispensing articles provided initially in a package is disclosed that comprises a frame configured to support the package of articles and a package-opening tool associated with the frame. The frame includes longitudinally opposed front and rear end sections, and an upper support deck extending at least partially between the front and rear end sections and below which a product display area is provided. The opening tool associated with the frame such that it opens the package when the package is moved longitudinally on the upper support deck and relative to the opening tool, thereby allowing the articles to be at least partially dispensed from the package into the product display area. The package may include a paperboard carton.

The disclosed dispensing system is suitable for use at a point-of-sale unit. Further, it may allow for an automatic feeding a first tier of the displayed articles towards the front of the system and an automatic replenishing a second tier of the displayed articles, such that the displayed articles may easily be accessed and picked by a consumer off the point-of-sale unit.

When desired, the frame may include a lower display deck. Additionally, the frame may further include at least one of: a rear wall which is configured to guide articles to the product display area, and a laterally opposed side walls. When appropriate, the laterally opposed side walls may be adapted and configured for guiding the package as it is moved longitudinally along the upper support deck. Furthermore, the frame may include article related indicia. The frame may further include a lane divider to create two display channels within the product display area.

The upper support deck may be inclined at an acute angle with respect to a horizontal plane. Moreover, the upper support deck may include two longitudinally extending rails.

The opening tool is arranged to open the package when the package is moved longitudinally along the upper support deck of the frame from the front end section toward the rear end section. The opening tool may be engaged with at least one of: the upper support deck, the first lateral side wall, the second lateral side wall, or a rear wall of the frame. In certain constructions, the opening tool may include a centrally positioned cutting panel.

When desired, the opening tool may include a first cutting element attached to the first lateral side wall of the frame and a second cutting element attached to the second lateral side wall of the frame. It is envisioned that the first and second cutting elements may be removably attached to the first and second lateral side walls of the frame, respectively. Additionally, the opening tool may include a centrally positioned cutting panel.

Further, the present disclosure relates to a method for dispensing articles provided initially in a package, the method comprising steps of:

(a) providing a frame configured to support the package of articles, the frame including:
  (i) longitudinally opposed front and rear end sections, and
  (ii) an upper support deck extending at least partially between the front and rear end sections and below which a product display area is provided;
(b) associating an opening tool with the frame;
(c) moving the package longitudinally in relative to the opening tool so as to open the package and allow the articles to be at least partially dispensed from the package into the product display area.

A first aspect of the present disclosure provides a system for dispensing articles, the system comprising:

(a) a supporting element configured to support a package of articles, and
(b) a package-opening tool associated with the supporting element such that it is configured to engage and open the package of articles when the package of articles is placed on the supporting element of the system.

In one embodiment of the first aspect, the package-opening tool comprises at least one cutting member operable to be inserted into the package of articles for cutting open that package of articles.

In one embodiment of the first aspect, the dispensing system further comprises:

(i) a structural framework configured and arranged to provide the supporting element and to provide a lower track in which the articles dispensed from the package can be accommodated and retained; and (ii) a forward feeding mechanism configured to encourage the articles, when dispensed out of the opened package, to move toward a front end of the lower track.

In one embodiment, the forward feeding mechanism is provided by at least of one of the following: by the supporting element being arranged at an inclined angle relative to a lower plane of the lower track; by an inclined floor of the lower track and the dispensing system comprising a back being scoop-shaped; by the dispensing system comprising a back and the forward feeding mechanism including one or more ramps extending at an inclined angle from the back toward a lower plane of the lower track.

In one embodiment, the dispensing system is a gravity feed system comprising:

(a) at least one track extending between front and rear opposed ends of the system to receive a row of articles for rolling movement along the at least one track, the at least one track including a lower supporting floor inclined downwardly toward the front end of the track;

(b) a supporting element being disposed above the at least one track for supporting a package of articles above the at least one track, the supporting element terminating at a vertical shaft area and being inclined toward the vertical shaft area to allow articles to gravity feed onto the at least one track through the vertical shaft area.

When desired, the vertical shaft area may be disposed adjacent the rear end of the dispensing system.

In one embodiment, at least one opening tool of the dispensing system may have an upper surface that is disposed at least in part above a part of the supporting element. The upper surface of the at least one opening tool may be disposed substantially parallel to a part of the supporting element. Additionally, the at least one opening tool may be vertically spaced apart from the supporting element.

In one embodiment, the dispersing system comprises a pair of opposed side walls each extending along the at least one track to define the at least one track, and a back wall interconnecting the side walls to define the rear end of the dispensing system, wherein the at least one opening tool being mounted, directly or indirectly, on at least one of the side and back walls.

In one embodiment, at least one opening tool may comprise a pair of side cutting fins mounted on the side walls respectively, the side cutting fins extending toward each other. When desired, the side cutting fins may be movably mounted to the side walls to be movable toward and away from the respective side walls, the side cutting fins being urged toward each other by resilient elements. Furthermore, the side cutting fins may be disposed above a part of the supporting element.

In one embodiment, the at least one opening tool further comprises an end cutting fin mounted on the back wall, the end cutting fin extending substantially into the shaft area.

In one embodiment, the at least one opening tool comprises a transverse cutting panel disposed above a part of the supporting element floor and extending transversely of the side walls. When desired, the transverse cutting panel may extend entirely between the side walls and is mounted on the side walls.

In one embodiment, the at least one opening tool further comprises a vertical cutting element extending downwardly from the transverse cutting panel to connect between the transverse cutting panel and the supporting element.

In one embodiment, the at least one opening tool further comprises a foot connected to a lower end of the vertical cutting element to connect between the vertical cutting element and the supporting element.

A second aspect of the present disclosure provides a dispensing system comprising:

(a) a rack device for supporting and displaying articles;

(b) a package-opening tool mounted on the rack device; and (c) a package of articles placed on the rack device in engagement with the package-opening arrangement such that the package is opened.

In one embodiment of the second aspect, the opening tool comprises at least one cutting member. Furthermore, in one embodiment, the package comprises an opening access which is configured to be activated to allow the package to open, and wherein the at least one opening tool is disposed in cutting engagement with the package to activate the opening access.

In one embodiment of the second aspect, the rack device comprises a loading station where the package is placed in engagement with the at least one opening tool, the loading station including a tilted upper supporting floor so that the package is downwardly inclined to the opening tool. When desired, the opening tool is activated to define in the package an opening access through which the articles can exit the package and gravity feed onto the rack device.

In one embodiment, each of the articles is substantially cylindrical in shape and the rack device further comprises at least one track disposed below the loading station, the at least one track extending between front and rear opposed ends of the rack device to receive a row of the articles for rolling movement along the at least one track, the at least one track including a lower supporting floor inclined downward toward the front end of the rack device.

In one embodiment, the rack device further comprises a vertical shaft area adjacent to the rear end of the rack device, the upper supporting floor terminating at the vertical shaft area so that the articles exiting the package are allowed to gravity feed onto the at least one track through the vertical shaft area.

In one embodiment, the articles contained in the package include a lowermost row of articles, and a base wall with which the articles of the lowermost row are in rolling contact, wherein the package is placed on the upper supporting floor with the base wall in contact with the upper supporting floor.

In one embodiment, the package-opening tool comprises at least one cutting member that is inserted at least partially into the package when the package is on the upper supporting floor such that the at least one cutting member is disposed between a base wall of the package and at least one of the articles in the package.

In one embodiment, the at least one opening tools is disposed at a distance from the rear end of the rack device, the distance being greater than the diameter of each of the articles.

In one embodiment, the at least one opening tool has an upper surface that is disposed at least in part above a part of the upper supporting floor.

In one embodiment, the at least one opening tool is vertically spaced apart from the upper supporting floor.

In one embodiment, the rack device further comprises a pair of opposed side walls each extending along the at least one track to define the at least one track, and a back wall interconnecting the side walls to define the rear end of the rack device, wherein the package is placed on the loading station with a rear wall of the package in abutment on the back wall of the rack device. When desired, the side walls of the rack device may be disposed alongside side walls of the package respectively.

In one embodiment, the package comprises an opening access that has been activated by the package-opening tool, wherein the opening access when activated defines an opening access in the package, and the opening access is disposed in alignment with the shaft area so that the articles exiting the package through the opening access are allowed to gravity feed through the shaft area.

A third aspect of the present disclosure provides kit of parts for forming a dispensing system, the kit comprising:

(a) at least one supporting element being configurable to support a package of articles; and (b) a package-opening tool including fixing means for mounting the package-opening tool on the system such that the package-opening tool is disposable relative to the supporting element such that it is configured to engage and configured to open a package of articles when the package of articles is placed on the supporting means of the rack device.

In one embodiment of the third aspect, the supporting element is integrally formed as part of a side panel of the system, and the kit comprises at least two such side panels and a back panel, wherein each side panel comprises a fixing element for attaching the side panel to the back panel and wherein the package-opening tool comprises at least two cutting elements each having fixing means for mounting the cutting element to one of the side walls in a position vertically aligned and vertically spaced from the supporting element.

In one embodiment, a forward feeding element is affixed to at least one face of each of the side panels and wherein the forward feeding element is formed as an inclined ramp.

A fourth aspect of the present disclosure provides a carton comprising:

(a) first and second walls connected together along a first severance line;

(b) a severance initiation area formed at least in part in the first wall such that the severance line is interrupted by the severance initiation area; and (c) a second severance line disposed substantially in the plane of the second wall, the second severance line extending generally perpendicularly to the first severance line.

In one embodiment of the fourth aspect, the package comprises: a substantially tubular structure; opposed top and bottom walls; and opposed side walls adjoining the top and bottom walls, wherein the bottom wall comprises two opening access either side of the second severance line, the opening access defined by the first severance line, the severance initiation area and the second severance line.

A fifth aspect of the present disclosure provides a blank for forming a package, the blank comprising a series of panels for forming the walls of the package including a bottom panel and adjoined by a weakened line to a bottom end flap, wherein a pair of access flaps is defined by a severance initiation area formed at least in part in weakened line adjoining the bottom panel and end flap: a first severance line disposed substantially parallel to and spaced from that weakened line, and a second severance line extending generally perpendicularly to the first severance line, intersecting the first severance line and terminating proximate the weakened line.

BRIEF DESCRIPTION OF THE DRAWINGS

FIG. 8A is a blank for forming a package according to yet a third package embodiment of the disclosure, which package is suitable for use with dispensing system shown in FIGS. 9A to 13C.

FIGS. 8B to 8C show a transparent perspective and side view respectively of the package formed from the blank of FIG. 8A.

DETAILED DESCRIPTION OF THE DISCLOSURE

Detailed descriptions of specific embodiments of the dispensing device apparatus and cartons are disclosed herein. It will be understood that the disclosed embodiments are merely examples of the way in which certain aspects of the disclosure can be implemented and do not represent an exhaustive list of all of the ways the disclosure may be embodied. Indeed, it will be understood that the apparatus and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the disclosure.

Figure 1A:
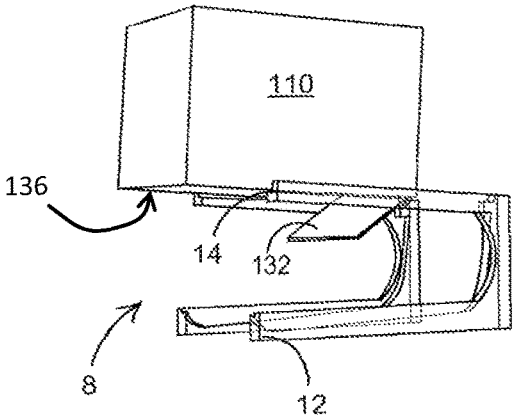
FIG. 1A is a perspective view from the front and side of a dispensing system and a package being loaded into the dispensing system according to a first embodiment of the disclosure.
Figure 1B:
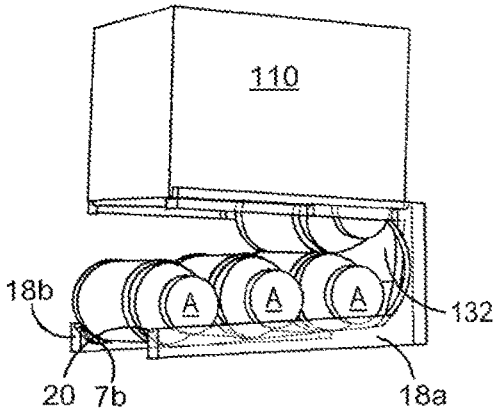
FIG. 1B is a perspective view from the front and side of the dispensing system of FIG. 1A with the package fully loaded into the dispensing system and articles having being emptied from the package into the dispensing system and displayed.
Figure 1C:
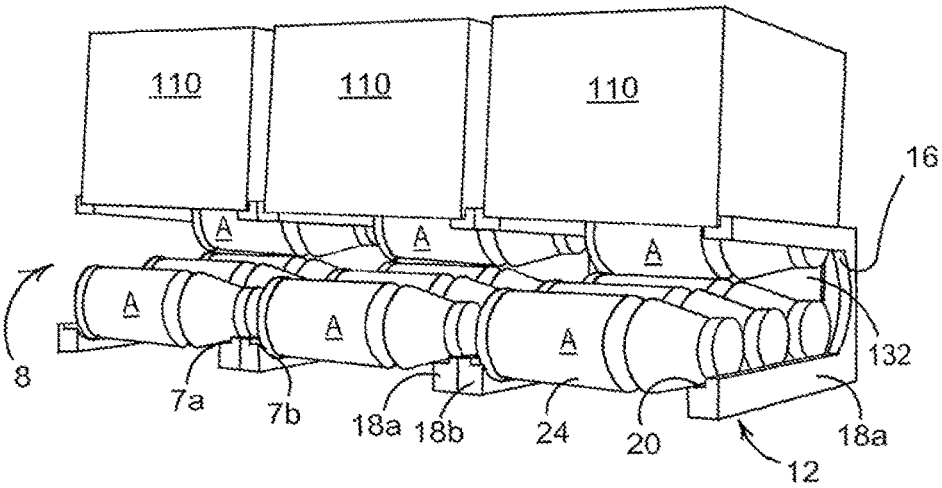
FIG. 1C is a perspective view from the front and side of three dispensing system of FIG. 1B disposed in side by side relationship on a store shelf.

FIGS. 1A and 1B show one embodiment of the disclosed system for dispensing and displaying a plurality of articles. FIG. 1C shows the three dispensing and displaying systems disposed side-by-side. The disclosed dispensing system 8 is configured to support a package 110 (shown in more detail in FIGS. 5A to 5E) which contains a plurality of articles A. In this example, the articles are bottles arranged in a 3×4 array with each bottle disposed upon their sides with the lowermost row in rolling contact with a base 136 of the package 110.

As shown in FIGS. 1A to 1C, the dispensing system 8 comprises a frame 12 that is configured to support the package 110, and a package-opening tool.

The frame 12 includes:

(a) longitudinally front and rear end sections; and (b) an upper support deck 14 supporting the package 110 from the package base 136 and extending at least partially between the front and rear end sections and below which a product display area is provided.

When desired, the frame 12 may include the sides 18*a* and 18*b* which define upper and lower levels, guide the package 110 along the upper support deck 14, as well as serve to guide articles A along the lower level, once being released from the package 110, toward the front end section of the frame 12. Additionally, the sides 18*a*, 18*b* may be formed with grooves or railings 7*a*, 7*b* in which a lower rim and upper rim of each article A is guided.

The articles A are released from the package 110 via an opening access 132. The opening access 132 may be moved from a closed position, wherein the articles A are securely retained within the package 110, to an opened position, wherein the opening access 132 is moved out of the plane of the base of the carton 110 to create an opening through which articles A held within the package may fall free of the package 110 and onto the dispensing system 8, where they are guided, one-by-one, by the grooves 7*a*, 7*b* in the lower level sides 18*a*, 18*b* toward the front end section of the frame 12. When desired, the opening access 132 may be designed such that it does not moved into a fully open position until the package 110 is fully installed or nearly fully installed on the upper support deck 14 of the dispensing system 8.

The opening access 132 is moved into its open position by a packaging-opening tool associated with the frame 12. The opening tool is co-operable with the opening access of the package and engages perforations 158*a*, 156*a* (FIG. 5A) which define the opening access 132, once the package 110 is installed by sliding movement along the supporting ledges at the upper support deck 14. Once the package 110 is so installed and the opening created, the articles A are automatically released from the package 110 into a product display area, which is the lower level of the frame 12.

The articles A may be successively released from the package 110 with the assistance of gravity. The upper support deck 14 may be angled or inclined relative to the plane of the lower level of the frame 12 to encourage the articles A in the package to gently roll toward the opening access in the package 110. When desired, the frame 12 may include a scoop shaped or arcuate back portion to prevent the articles from rolling out of the frame 12 and beneficially encourages the articles, by providing a path for them to follow, to roll around and down onto the lower level of the frame. The gravity feed mechanism causes the articles A to be supplied automatically to the front section end of the lower level of the frame 12. A stopping mechanism 20 formed as an upturned or radiused portion of grooves 7*a*, 7*b* (provided on each lower side 18*a*, 18*b*) prevents the front-most article A, contained in dispensing position 24, from rolling completely out of the frame 12. The stopping mechanism 20 acts to retain the articles A within the lower level of the frame 12.

Figure 2:
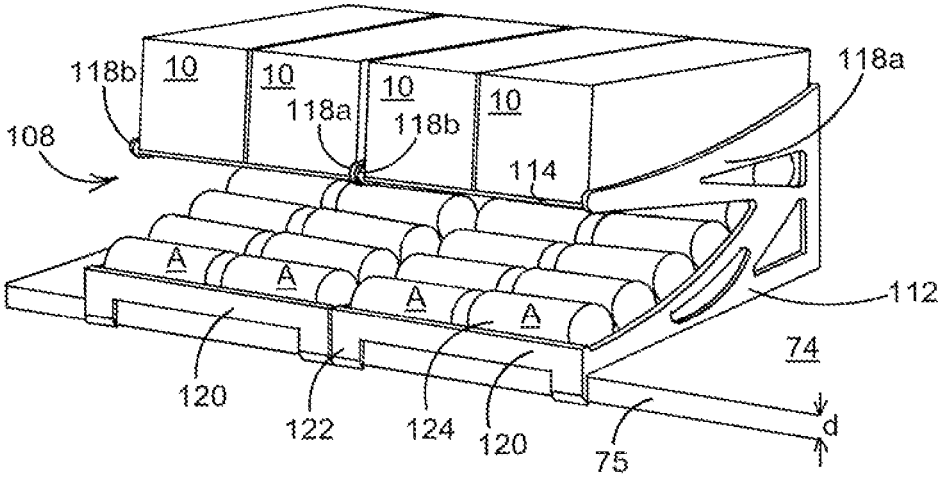
FIG. 2 is a perspective view from the front and side of two dispensing systems according to a second embodiment of the disclosure that are disposed in side by side relationship on a store shelf with four packages shown as having been fully loaded into the dispensing systems and articles having being emptied from the packages into a lower track of the dispensing systems.

In FIG. 2, the display unit including two dispensing systems 108 are shown. Each dispensing system 108 is wide enough to receive two packages 10, disposed in side-by-side relationship on the upper support deck 114 (or alternatively one double width package) of the respective frame. The packages 10 are guided into the upper support deck 114 by means of the packages fitting closely and slidably between side walls 118*a*, 118*b* which extend alongside both the upper and lower level of the frame 112. The extended side walls 118*a*, 118*b* also help to guide the articles A as they are emptied from the packages 10 toward a stopping mechanism 120 provided as a front edge or front lip integrally formed with the sides 118*a*, 118*b* of the respective frame 112. The front edge 120 is optionally integrally formed with a shelf fixing device 122 to enable the dispensing system 108 to be secured to a shelf 74 in a store or retail outlet. The shelf fixing device 122 is formed as an extension of the stopping device 120 and extends as a clip with the stopping device or front lip 120. The shelf fixing device 122 has a 'C' shaped (or square-'C' shaped) cross-section which fits on top of the shelf 74, down the front-edge or front face 75 of the shelf 74 and underneath the shelf 74. The shelf fixing device 122 has a depth 'd' approximately equal to the depth of the shelf 74 (as illustrated by the front edge 75 and reference 'd' in FIG. 2).

When desired the frame 112 does not necessarily comprise a bottom portion, but rather the shelf 74 may provide a surface onto which the dispensed lower level articles A can rest. The frame 112 comprises a ramp to encourage the articles rolling out of the package 10 to roll toward the stopping mechanism or front lip 120. A back portion of the frame provides structural support to the frame 112 as well as a rear stopping device to prevent articles exiting the package from rolling free of the rear of the frame 112. The sides 118*a*, 118*b* are shaped to follow the path of the rolling articles in the lower level. The upper support deck 114 may be inclined downward and backward to encourage rolling of the articles toward the dispensing position 124 (the position of the front most article that will be picked out first by a customer).

The principle of operation of the dispensing system of FIGS. 1A to 1C and FIG. 2 is similar to the principle of operation of the various display and dispensing systems to be herein described with reference to the remaining FIGS. 3A to 19B. The package 110 provides a single and ordered collection or a magazine of articles A that is easy to handle and manipulate. The package 110 is loaded onto and guided by an upper support deck of the frame 12 and as such a full set of articles A is loaded in one single operation into the dispensing system 8. The dispensing system 8 comprises a package-opening tool which is operable in-conjunction with a complimentary formed opening access 132 provided on the package 110. As the package is loaded into the dispensing system 8 or 108, the opening tool engages or interacts or manipulates the opening access 132 of the package 110 to create an opening in the package base 136 of the package 110 through which the articles A may be individually released into the lower level of the frame 12. The dispensing system is thereby stocked and articles A are either stored in the package 110 for subsequent dispensing into the system 8 or the articles A are displayed in the lower level of the frame 12 for retrieval by a customer. Upon removal of the front most article A, a forward feed mechanism causes automatic replenishment of the lower level and front most position of the lower level of the dispensing system 8 from the supply of articles A contained in the package 110. Once the package 110 is empty, the empty package 110 can be removed from the dispensing system (simply by lifting out or by sliding withdrawal along the upper support deck 14) and replaced by a new one. When the last article A drops out of the package 110, the lower level of the dispensing system may be full. This means that the front-most article location 124 contains an article A and as such the display and presentation of articles for being picked by a customer is in its optimum position.

The package 110 may remain on the upper level even after it has been emptied, to serve as billboard panel. To this end the package 110 and its front end wall in particular may be printed with graphics including trademarks and/or any other advertising indicia. However, the package 110 may be replaced by a new one, as soon as it is emptied, to mitigate the chance that an article A will be taken from the lower level of the frame 12 before a fresh supply of articles is available to replenish the lower level and the front-most position 124. The need for any secondary storage of articles contained in the package but not displayed by the dispensing system is mitigated by the loading of only completely full packages onto the dispensing system.

In view of the fact that the principle of operation of the dispensing systems of later embodiments is the same or similar to that of the first dispensing systems described above, in the foregoing description of later embodiments only differences and additional technical features will be described in greater detail.

FIGS. 3A to 3D show one embodiment of the packages, wherein the package is co-operable with the dispensing systems of FIG. 2 and FIGS. 4A to 4D.

Figure 5A:
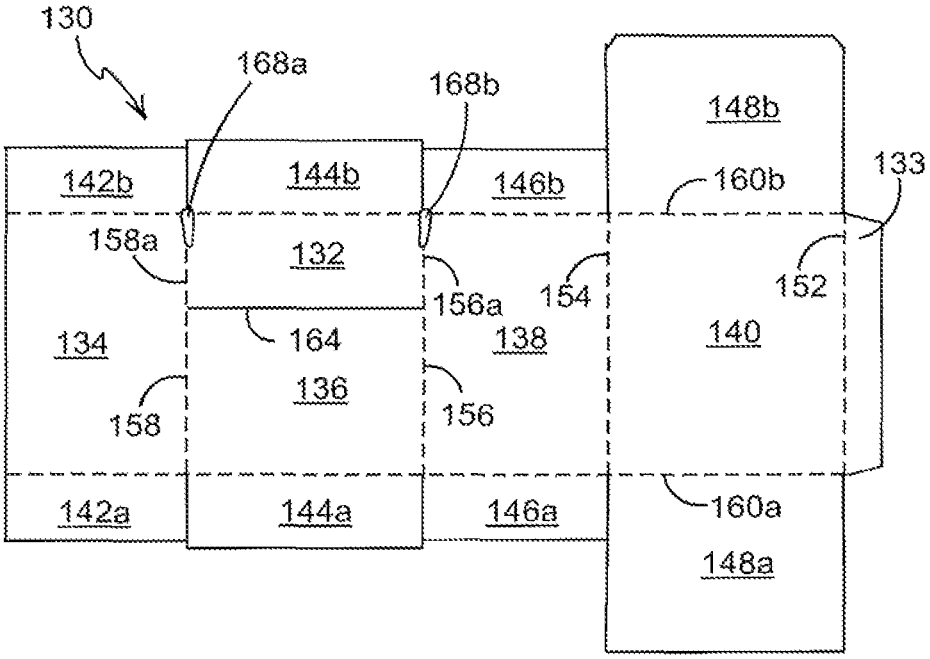
FIG. 5A is a blank for forming a package according to a second package embodiment, which package is suitable for use with dispensing systems shown in FIGS. 1A-1C, FIGS. 6A to 6D, and FIGS. 7A-7C.
Figure 5B:
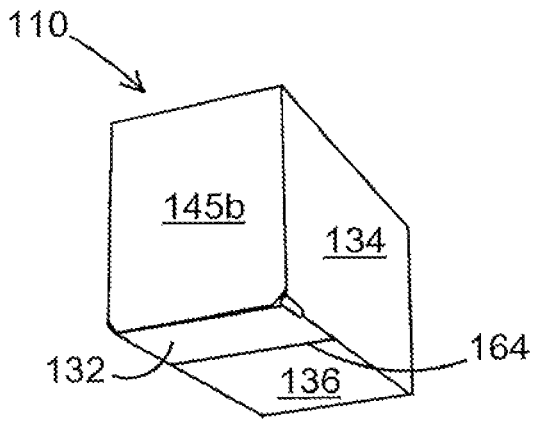
FIGS. 5B to 5E show perspective views and a side view respectively of a package formed from the blank of FIG. 5A having an access means positioned to the rear of the bottom panel of the package.
Figure 5C:
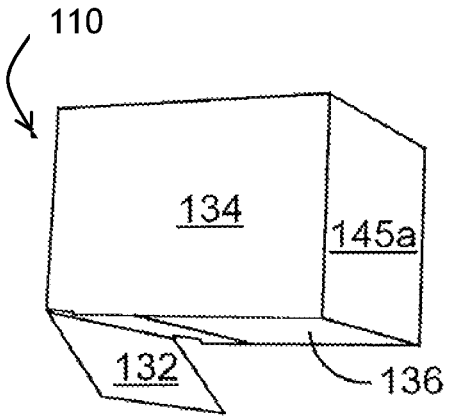
Figure 5D:
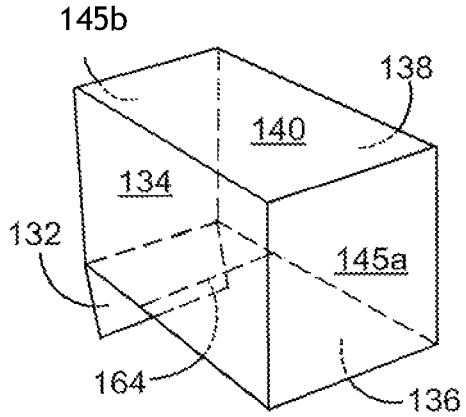
Figure 5E:
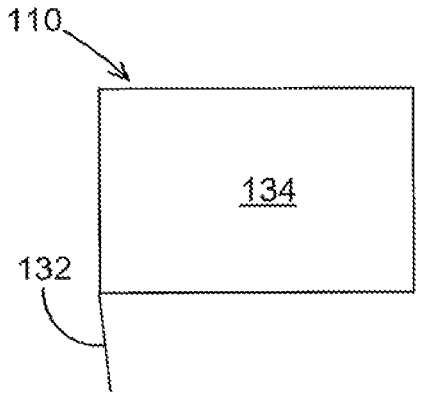
Figure 6A:
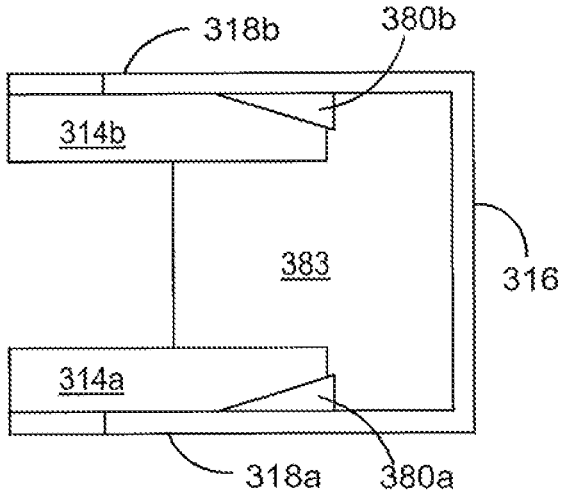
FIGS. 6A to 6D show top, perspective and side views respectively of a dispensing system according to a fourth embodiment of the disclosure having two side opening tools.
Figure 6B:
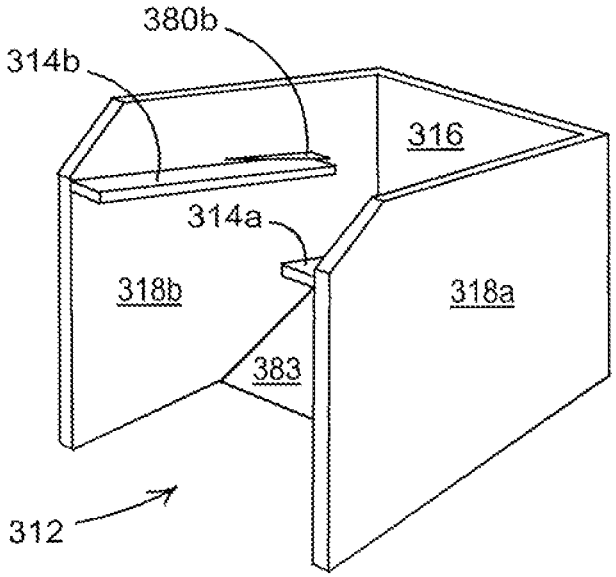
Figure 6C:
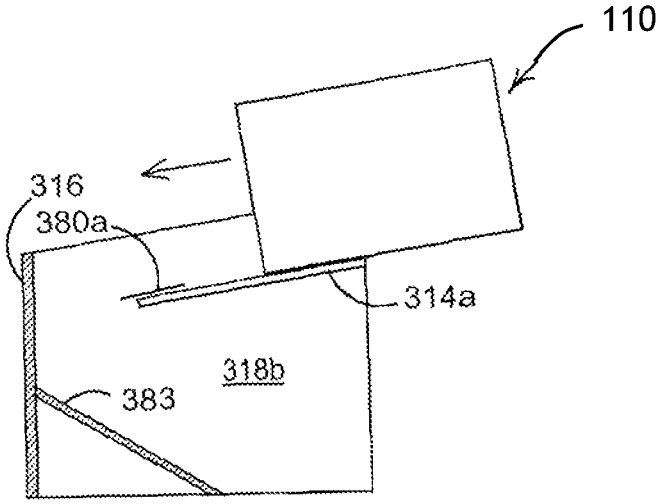
Figure 6D:
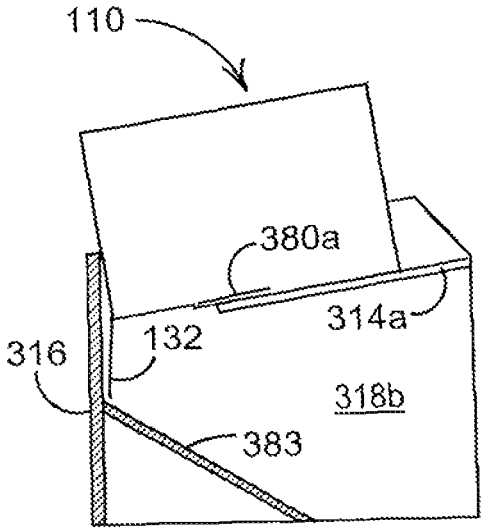
Figure 7A:
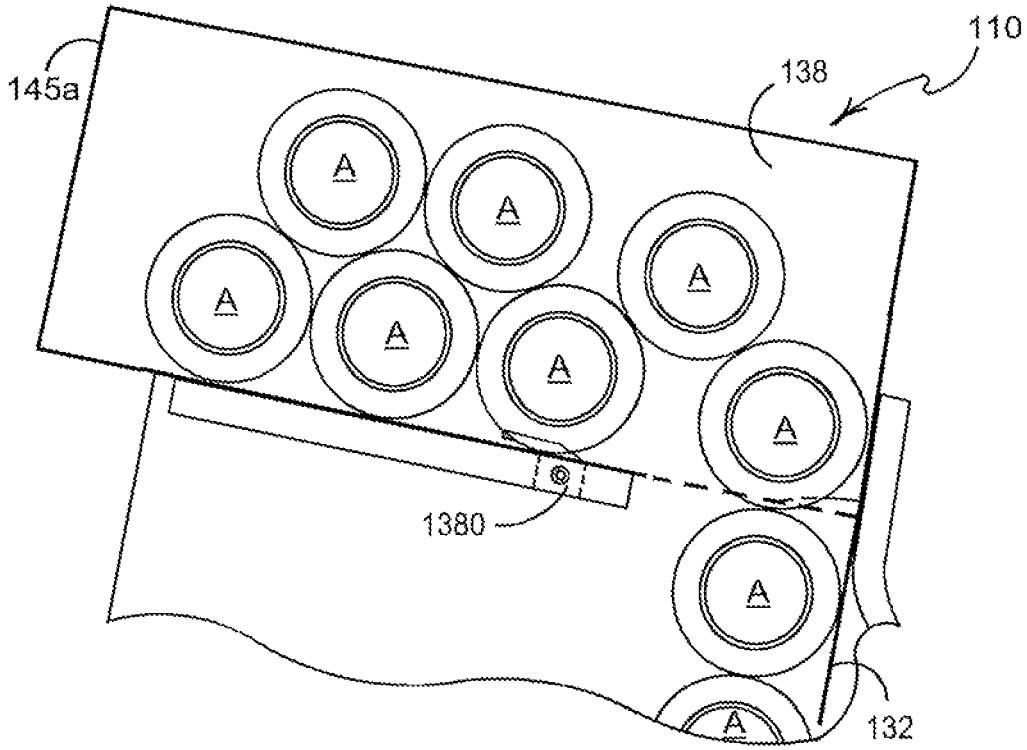
FIGS. 7A to 7C show side and top views of a dispensing system and a close up view of an opening tool respectively according to a fifth embodiment of the disclosure.
Figure 7B:
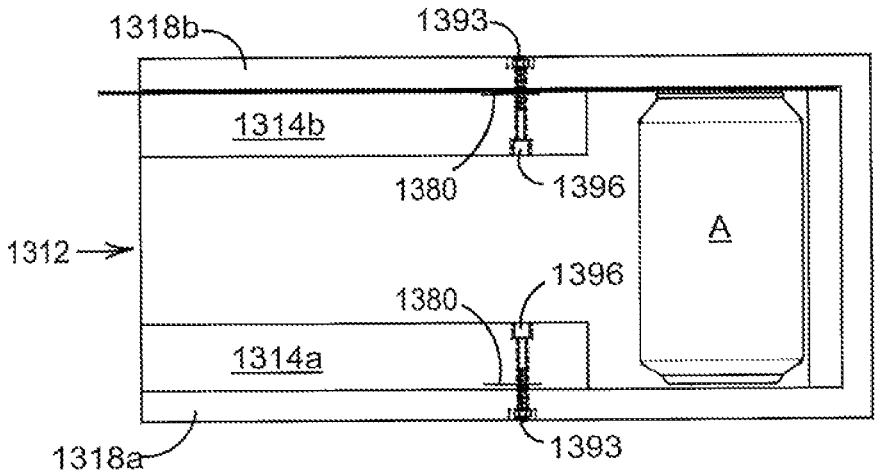
Figure 7C:
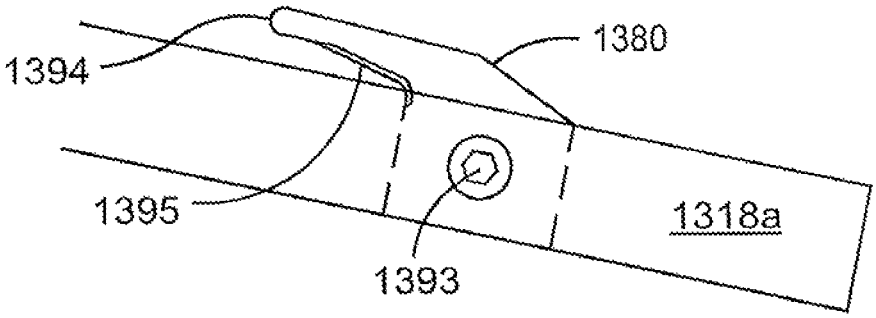

FIGS. 5A to 5E show one embodiment of the packages, wherein the package is co-operable with the dispensing system 8 shown in FIGS. 1A-1C, in FIGS. 6A6D; in FIG. 7A 7C; and the dispensing system utilizing the variant retractable cutting tools shown in FIGS. 10A-10D.

FIGS. 8A to 8C show one embodiment of the packages, wherein the package is co-operable with the dispensing system of FIGS. 9A to 13G.

In the various embodiments illustrated like reference numerals have, where possible been used to denote like features generally albeit with a different numerical pre-fix ('100', '200' '1000', etc.) to distinguish the different embodiments from one another. For example, the packages shown in FIGS. 3B, 5B and 8B are numbered as 10, 110 and 210 respectively.

Figure 3A:
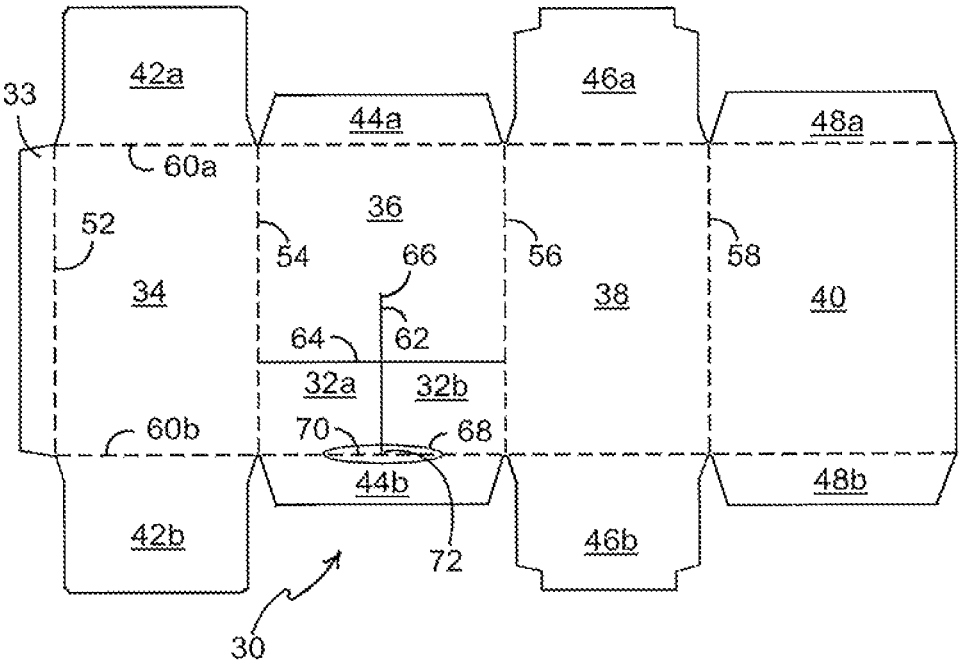
FIG. 3A is a blank for forming a package according to a first package embodiment, as illustrated in FIGS. 3B to 3D, the first embodiment for use with dispensing systems such as those illustrated in FIG. 2 and FIG. 4A to 4C.
Figure 3B:
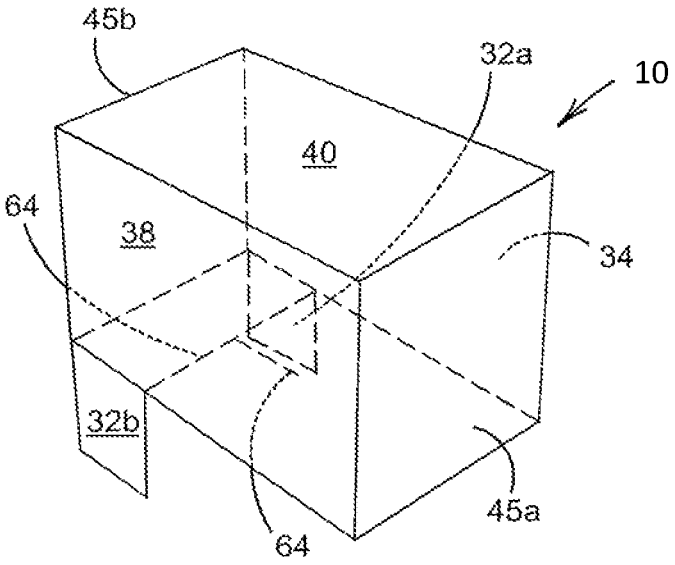
FIG. 3B is a transparent perspective view from the front and side of a package formed from the blank of FIG. 3A wherein bottom opening access have been opened.

FIG. 3A shows one embodiment of the blank 30 for forming a package that is suitable for use with the disclosed dispensing system. When desired, the blank may made of paperboard. The blank 30 is generally for a known type of fully enclosed end loading style package and comprises: a top panel 40, first side panel 38, bottom panel 36, second side panel 34, glue flap 33 and end closure panels 42*a*, 44*a*, 46*a*, 48*a*, 42*b*, 44*b*, 46*b*, 48*b*. The main panels (the top panel 40, first side panel 38, bottom panel 36 and second side panel 34) are hinged one to the next in series along fold lines 58, 56, and 54, respectively. The glue flap 33 is connected to the second side panel 34 along fold line 52. The end closure panels 42*a*, 44*a*, 46*a*, 48*a*, 42*b*, 44*b*, 46*b*, 48*b* are hinged to opposite ends of the main panels along fold lines 60*a* and 60*b* respectively. The blank 30 is foldable into a formed structure where the glue flap is secured to the inner face of top panel 40 and the top panel 40 and first side panel 38 have been folded into overlapping face contacting relationship with the first side panel 38 and bottom panel 36. The formed structure is openable into an open ended tubular structure and loaded from one or both ends with articles A. The end closure flaps 42*a*, 44*a*, 46*a*, 48*a*, 42*b*, 44*b*, 46*b*, 48*b* are foldable and securable (using adhesive or other suitable securing means including mechanical fastenings) to form a composite front end wall 45*a* and a composite rear end wall 45*b* respectively (see FIG. 3B). In this way, a fully formed and loaded package that secures articles therein is formed.

FIGS. 5A and 8A show one embodiment of the blanks 130, 230 for forming the packages suitable for use with the dispensing systems 110 and 210. The blanks 130, 230 have the same basic structure as that described in the preceding paragraph with respect to blank 30. Therefore, in later paragraphs when these blanks 230, 330 are further described, only the differences between the bottom panels 36, 136, 236. Thus, the access structures 32*a*/32*b*, 132, 232 will be discussed in detail.

In FIG. 3A, the bottom panel 36 of the blank 30 is provided in a pre-formed weakened arrangement or series of perforations, folds and cut lines for creating an opening access. Toward the rear end of bottom panel 36, a transverse cut line or severance line 64 is provided. This cut line 64 defines in part each of two opening access 32*a*, 32*b*. The opening access 32*a*, 32*b* are further defined by a longitudinal cut line or second severance line 62 extending medially along the bottom panel 36, from the first severance line 70 adjoining end flap 44*b* to the bottom panel 36, between the two opening access 32*a*, 32*b*, across the cut line 64 and terminating approximately half way along the bottom panel 36 at end point 66. The start of longitudinal cut line 62 is positioned on the first severance line 70 (denoted by reference 72 in FIG. 3A). A perforation 68 is defined about a portion of that fold line 70. The perforation 68 defines an elliptical weakened piece or severance initiation area that extends into end flap 44*b* and into bottom panel 36.

To open the opening access 32*a*, 32*b*, the severance line 64 is broken first. Then, the severance initiation area, defined by perforation 68, is presses inwardly of the package. This is assisted by the presence of the starting end 72 of longitudinal cut line 62. Once the severance initiation area 68 is broken, the remainder of the severance line 70 on the opposite sides of the area 68 and the severance line 66 are completely broken to allow the opening access 32*a*, 32*b* to fold downwardly from the bottom panel 36 about fold lines 54 and 56 respectively. The open position of the package 10 is shown in FIG. 3B. Optionally, severance lines 62, 64 are severance-assisting lines that are not significantly weakened but can be broken by means of a cutting tool. In this way the bottom panel 36 retains its structural strength during the time the package 10 acts as a secure packaging means for transporting and protecting the articles A contained therein. However, once opening of the package 10 is required, the severance-assisting lines 62, 64 are easily broken to gain access to the articles A.

Figure 3C:
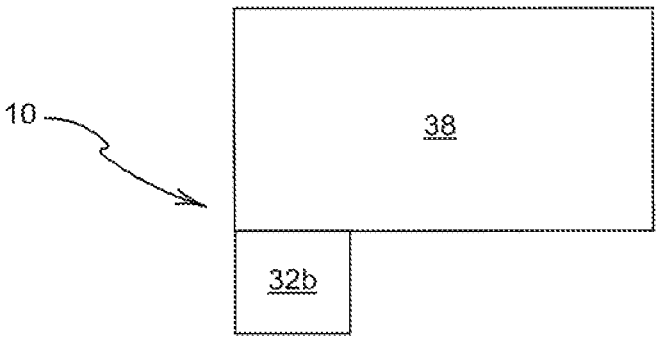
FIG. 3C is a side view of the package of FIG. 3B.
Figure 3D:
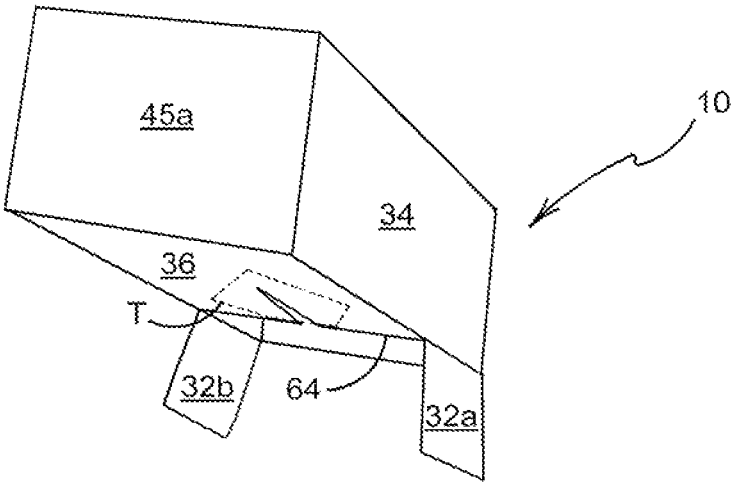
FIG. 3D is a perspective view from the front, side and bottom of the package of FIG. 3B, showing in dotted outline, the final position of an opening tool of the dispensing system of FIGS. 4A to 4C.

Further views of the open carton 10 are shown in FIG. 3C and FIG. 3D. In FIG. 3D, an outline of a cutting tool or opening device "T" of the dispensing device 1212 of FIGS. 4A to 4C is shown in dotted outline to illustrate the final position of that opening device 1280 once a package, such as package 10, has been installed in the dispensing system 1212 of FIGS. 4A to 4C.

Figure 4A:
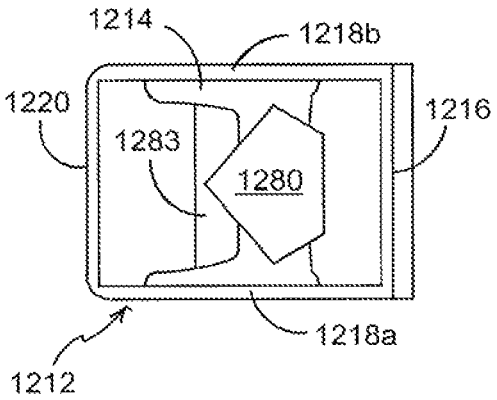
FIGS. 4A to 4C show top, side and perspective views respectively of a dispensing system according to a third embodiment of the disclosure having a trowel shaped opening tool.
Figure 4B:
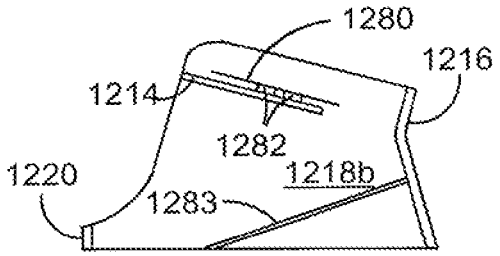
Figure 4C:
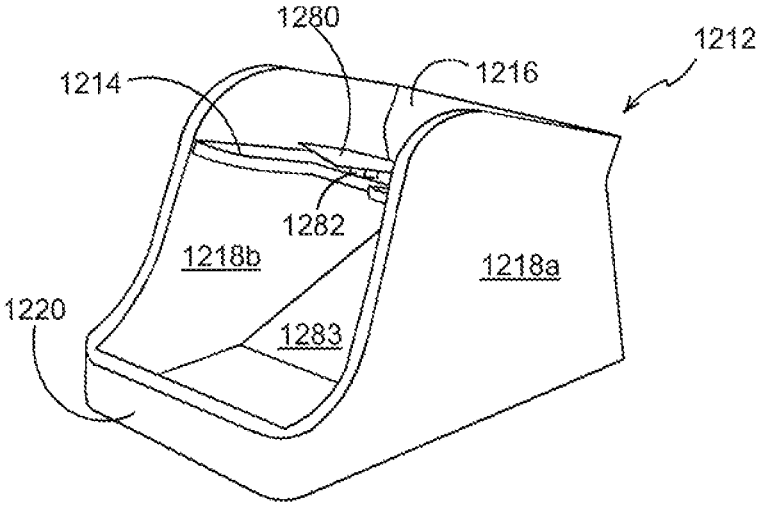

FIGS. 4A and 4B show one embodiment of the disclosed dispensing system. The dispensing system 1212 is suitable for co-operative use with the package 10 having opening access 32*a*, 32*b*.

Dispensing system 1212 may be formed for a variety of materials. These include, but are not limited to, lightweight yet suitably strong plastics, plastic-fiber composite material, metal, wood, ply wood, and combination thereof. The dispensing system 1212 comprises side walls 1218*a*, 1218*b* and a front stopping mechanism 1220 adjoined thereto and a back wall 1216 also adjoined to the side walls 1218*a*, 1218*b* in a sturdy frame like structure. Optionally, the dispensing system 1212 may not include a base component; once installed at a point of sale unit, the store shelf will provide the base onto which dispensed articles may be placed.

When desired, the dispensing system may comprise a ramp 1283 formed as an integral component of the dispensing system and a support deck 1214 onto which a package (such as package 10) can be disposed. The ramp 1283 extends from the back 1216 toward the plane of the lowest level of the side walls 1218*a*, 1218*b*, back 1216 and stopping mechanism 1220. The ramp 1283 may be formed as a single, solid unitary extension of the back 1216 and encourage rolling of dispensed articles A toward the front dispensing position. Front stopping mechanism 1220 (provided as a solid wall of material) prevents those articles from undesirably rolling free of the dispensing system 1212. The forward feeding mechanism or ramp 1283 and front stopping mechanism 1220 in other embodiments are provided as a track and/or framework rather than a solid wall of material.

In addition the dispensing system comprises a cutting means or cutting tool (also referred to as an opening mechanism or package-opening tool) 1280 formed of plastic or metal that is shaped in a "trowel" like manner having five-sides with a pointed front portion (see FIG. 4A for top view of opening device 1280). The opening tool 1280 is mounted on the support deck 1214 and further comprises one or more (shown with two in FIG. 4D) keel elements the forward one of which is a cutting element 1282. The keel elements 1282 are disposed as vertical extensions from the planar "trowel." The forward keel element provides a further cutting blade or cutting means for opening a package, such as package 10.

From the side view of FIG. 4B in conjunction with FIG. 3C, it will be understood that as the package 10 is slidably loaded or installed onto support deck 1214, feeding the rear-end composite wall 45*b* first, that the pointed portion or leading edge of the opening tool 1280 is inserted into the opening defined by severance initiation area 68. In this way as an operator pushes the package along the support deck 1214 toward the back 1216 of the dispensing system 1212, the opening tool 1280 is pushed further into the package 10 between the bottom wall 36 and the lowest most row of articles A. The diverging or widening shape of the opening tool 1280 causes the severance lines or perforate lines 70 on either side of the severance initiation area 68 to break. When the package 10 is pushed further and comes into contact with the keel elements 1282, these elements assist the breaking, or cutting open of severance line 62 and the separation of the two opening access 32*a*, 32*b*. The keel structures 1282 also may help to encourage the access panels 32*a*, 32*b* to fold either side of the keel structures 1282. The opening operation may be assisted by the weight of the articles held in the package sitting on the weakening bottom wall 36. The downward force of their weight applies additional pressure to assist in opening the access 32*a*, 32*b*. For example, the severance line 64 may be designed such that it can automatically break due to the weight of the articles as the other severance lines 70 and 62 are broken. Otherwise, the severance line 64 may be manually broken prior to the placement of the package onto the dispensing device.

The overall size of the opening tool 1280 is such that the opening tool 1280 provides, itself, a stop to prevent articles dropping through the bottom of the package, until the package has been further installed into the dispensing system 1212. As the opening created by the downwardly folded access 32*a*, 32*b* passes the opening tool 1280, the opening becomes clear of obstruction and available for the dispensing of articles. The position of the cutting tool 1280 relative to the bottom panel 36 and opening access 32*a*, 32*b* once the package 10 has been fully installed in the dispensing system 1212 is shown in FIG. 3D. It can be seen that the substantially rectangular opening created by the opening of the access 32*a*, 32*b* is further to the rear of the dispensing system 1212 and articles disposed above that opening will fall from the package down a notional vertical shaft and onto the lower tier or lower track provided between side walls 1218*a*, 1218*b* and guided by the forward feeding mechanism or ramp 1283. The lower tier between side walls 1218*a*, 1218*b* and back 1216 and stopping mechanism 1220 provides a gravity feed track into which the articles A can roll.

Figure 4D:
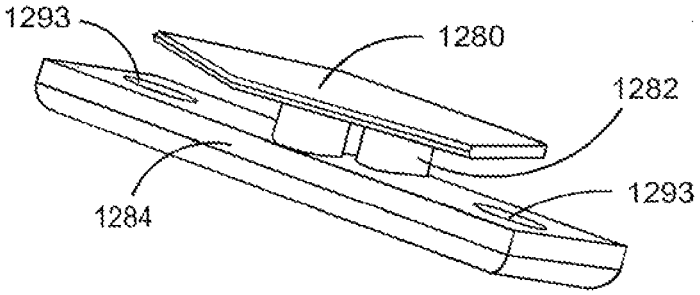
FIG. 4D shows a perspective view of the trowel shaped opening tool used in the dispensing system of FIGS. 4A to 4C.

The package-opening tool or cutting element 1280 is shown in FIG. 4D in a perspective illustration from the front of the package opening system 1280. The opening tool is optionally mounted by means of the vertical keel element 1282 onto a platform 1284. The platform 1284 comprises fixing means 1293, which take the form of screw retaining holes, through which screws are used to attach the platform 1284 directly onto the support deck 1214. The platform 1284 is optional. In other envisaged embodiments, the opening tool 1280 may integrally formed with the support deck 1214. The fixing means 1293 is also optional, but where present may take many and various forms. Examples of such fixing means include, but are not limited to mechanical fastenings such as nails, pins, clips, nuts, tape; bindings; or chemical bonding such as glue adhesive, plastic weld, heat melt glue.

FIG. 5A showed one embodiment of the blank for forming the package suitable for use with the disclosed dispensing system. The blank 130 comprises an opening access 132 defined by a transverse severance line 164, opposed pairs of severance lines 156*a*, 158*a* and the portion of fold line 160*b* between rear end closure flap 144*b* and bottom panel 136.

In one embodiment, the package comprises a pair of severance initiation areas in the form of apertures 168*a*, 168*b*. The package-opening tools of suitably formed dispensing system can engage the package 110 formed from the blank 130 by first being inserted into the pair of opening apertures 168*a*, 168*b*.

In one embodiment, the package comprises a pair of severance initiation areas in the form of weakened corner portions. FIGS. 6A to 7C show exemplary disclosed dispensing systems that are co-operable with the package 110 or co-operable with similar packages wherein a pair of severance initiation areas in the form of weakened corner portions rather than apertures.

FIGS. 6A to 6D show one embodiment of the dispensing system, wherein the system comprises a pair of opposite side walls 318*a*, 318*b* adjoined by a back 316. The side walls 318*a*, 318*b* define in part a track and a support deck above the track. The support deck is further defined by pairs of deck elements or supporting ledges 314*a*, 314*b* onto which a package 110 can be positioned. The dispensing system also comprises a forward feeding mechanism 383 provided in the form of an inclined ramp extending from the back 316 toward a plane containing the lowest plane of the sides 318*a*, 318*b* and hence toward to the lowest plane of the lower track. The deck elements 314*a*, 314*b* may be inclined to encourage articles A in the package 110 to roll toward the rear end of the package 110. A pair of opening tools in the form of cutting fins 380*a*, 380*b* is provided in vertical alignment with the deck elements 314*a*, 314*b* respectively. The cutting fins 380*a*, 380*b* are substantially planar elements and are disposed in substantially parallel alignment with the deck elements 314*a*, 314*b*. Where the deck elements 314*a*, 314*b* are inclined, the opening tools 380*a*, 380*b* may also be similarly inclined. In other embodiments, the deck elements 314*a*, 314*b* may not be disposed in vertical alignment with the opening tools 380*a*, 380*b*. For example, the deck elements 314*a*, 314*b* may be extended from the back 316 (substantially centrally of the dispensing system 312) and the opening tools 380*a*, 380*b* extend from the sides 318*a*, 318*b*.

The opening tools 380*a*, 380*b* are, in this illustrated example, triangular in shape. The tapered shape of the opening tools 380*a*, 380*b* enables the package 110 to be gradually pushed onto the opening tools 380*a*, 380*b* as the package 110 is installed or loaded into the dispensing system 312 by sliding the bottom 136 of the package along the deck elements 314*a*, 314*b*. The pointed narrowest portion of each opening tools 380*a*, 380*b* is inserted into the severance initiation opening 168*a*, 168*b*. As the package 110 is further installed into the system 312, wider portions of the tapered opening tools 380*a*, 380*b* are pushed into and through the opening apertures 168*a*, 168*b* progressively breaking the severance lines 158*a*, 156*a*. Once the severance lines 158*a*, 156*a* are completely broken, the opening access 132 can fold downwardly (encouraged by the weight of the articles disposed in the package above the opening access), thereby the opening tools have engaged the package 110 to create an opening in the package through which articles are dispensed into the lower tier or lower track of the dispensing system 312. It should be appreciated that the severance line 164 may be designed such that it can break automatically as due to the weight of the articles in the package as the severance lines 156*a* and 158*a* are broken. Otherwise, the severance line 164 may be manually pre-broken before the package 110 is place on the dispensing system 312.

It will be understood by those skilled in the art, having read the foregoing description of opening tools 380*a*, 380*b*, that other shapes of opening tools are suitable for achieving breaking of a weakened portion of a package and that many variations of packages and opening tools may be used in implementing the present disclosure. For example, the leading portion of the opening tools may be squared off, rounded, pointed, or angled. Furthermore, the taper angle of the opening tools may be many. The pair of opening tools 380*a*, 380*b* may not be symmetrical. The opening tools 380*a*, 380*b* may not be triangular.

FIGS. 7A and 7C illustrate embodiments in which a pair of opening tools 1380*a*, 1380*b* is disposed adjacent to and in substantially parallel alignment with side walls 1318*a*, 1318*b* of the dispensing system 1312. The pair of opening tools 1380*a*, 1380*b* is optionally affixed to the sides 1318*a*, 1318*b* via a screw fixing 1393 mating in a plug of screw socket 1396. The pair of opening tools 1380*a*, 1380*b* are substantially planar elements. Several materials may be used for the opening tools. These include, but are not limited to, plastics, metal, or a combination of plastic with a metal blade portion 1395. Each opening tool 1380*a*, 1380*b* is hook shaped having a tip 1394. The shape of the tip 1394 permits the narrow tip to be inserted into an aperture 168*a*, 168*b* and allows the blade 1395 (which may be metal and may be sharp) to be shielded from being contacted by a user or customer while allowing the blade 1395 to contact and cut along lines of perforation 158*a*, 156*a* as the package 110 is installed in the dispensing system as shown in FIG. 7A and 7B. The opening tools 1380*a*, 1380*b* may be formed sufficiently thinly to fit between a side panel 138, 134 of the package and the articles A contained in the package. In FIG. 7C, a can is shown as a generally cylindrical article disposed in the package 110 and the opening tools fit between the end of the can and the side panel 138, 134.

FIG. 8A showed one embodiment of the blank for forming the package suitable for use with the disclosed dispensing system. The blank 230 comprises a severance initiation opening portion 268 disposed along severance line or perforate line 243. An opening access 232 is defined by opposed severance lines 258*a* and a fold line 264. To open the opening access 232, lines 243 and 258*a* are broken. Thus, the opening access 232 hinges about fold line 264 as illustrated in FIGS. 8B and 8C such that a substantially rectangular opening is created at the rear end of the bottom wall 236 and the opening access hinges about fold line 264 disposed about a one article diameter or more from the end of the package 210.

Figure 9A:
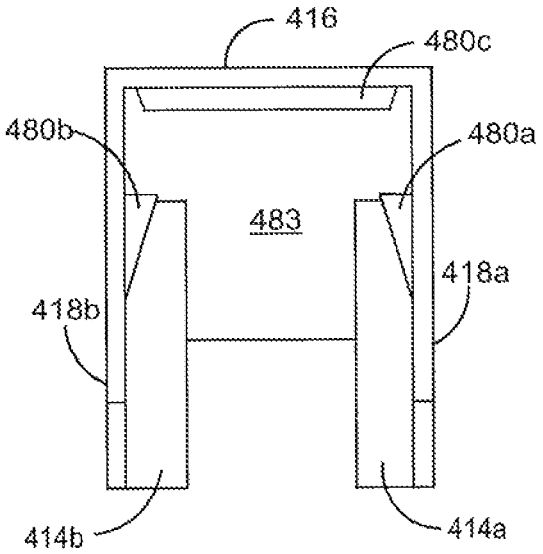
FIGS. 9A to 9B show perspective and top views respectively of a dispending system according to a sixth embodiment of the disclosure having three opening tools.
Figure 9B:
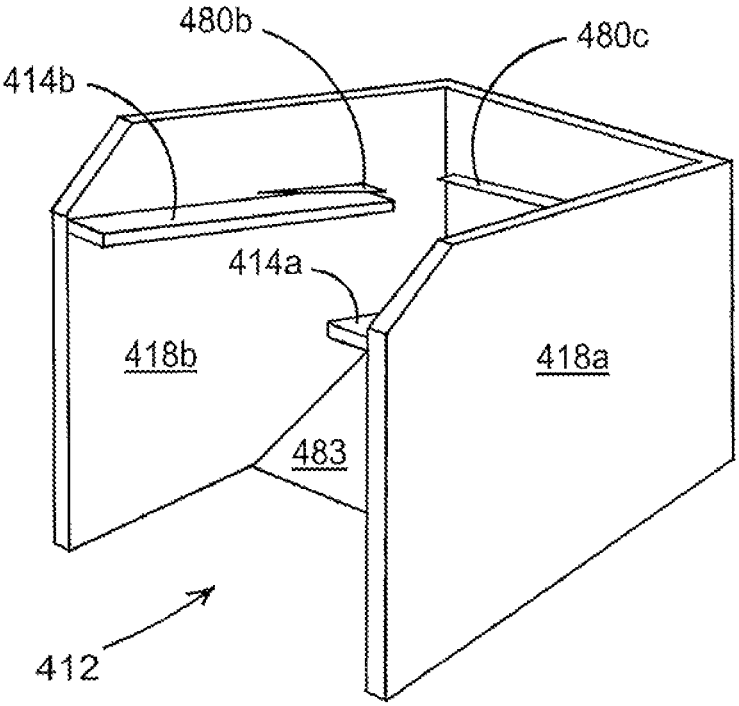

FIGS. 9A and 9B illustrate one embodiment of the disclosed dispensing system, wherein the system facilitates the automatic opening of the package 210 as the package is loaded into a dispensing system. The dispensing system 412 does not comprise a stopping mechanism as this can be provided by a store shelf itself. Furthermore, in other embodiments, the dispensing system 412 may not include a stopping mechanism. In some embodiments, the dispensing system may optionally include a front lip. Attached to sides 418*a*, 418*b* is a pair of support elements 414*a*, 414*b* and a pair of opening tool 480*a*, 480*b*. The opening tool 480*a*, 480*b* are similar to those described in relation to FIGS. 6A to 6D. However, in order for the opening access 232 to be accessible, perforate line 243 must be broken. This is optionally achieved by a third or rear opening tool 480*c* affixed or integrally formed with the back 416 of the system 412. As the package is fully installed into the system 412, the last push to fit the package 210 into the system causes the rear opening tool 480*c* to break the perforate line 243. Thereafter, the opening access 232 is folded about fold line 264 away from the bottom panel 136 to create the opening through which the articles A can be dispensed.

Figure 10A:
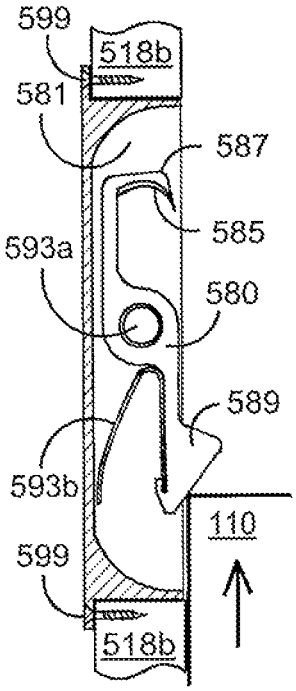
FIGS. 10A to 10D show cross-sectional views of a pivotally retractable opening tool and a side view of the retractable opening tool usable for example in the dispensing systems of FIGS. 6A to 6D and 9A and 9B.
Figure 10B:
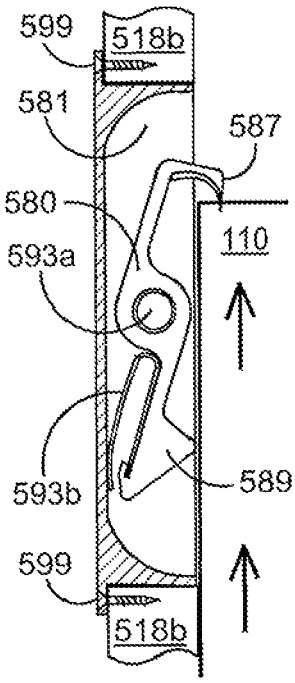

The opening tools described so far are optionally fixed in the position described and do not move. However, as a further variation, a retractable mechanism can be provided in conjunction with each opening tool to enable the cutting element to be biased into a stowed position within the structural framework of the system. For example, it may be at the side, back or supporting element. An exemplary retractable mechanism is illustrated in FIGS. 10A and 10B. It will be understood that the retractable mechanism is exemplary only and other mechanisms for biasing a cutting element into a stowed position and for causing the opening tool to be moved into a use position in response to the initial loading of a package into the system are envisaged.

Figure 10C:
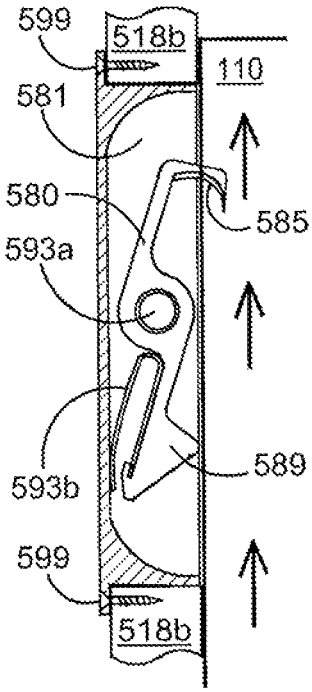
Figure 10D:
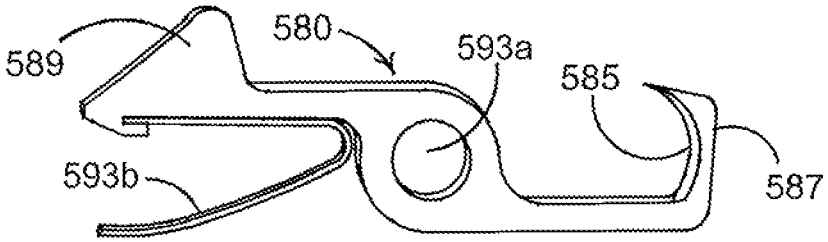

FIGS. 10A to 10D show one embodiment of the opening tool 580 comprising a hooked tip 587, a pivotal element 593*a*, an optional blade 585 (optionally formed of metal), a levering button 589, and a biasing member 593*b*. The opening tool 580 is arranged to fit within a stowing void 581 within a side wall 518*b* of the disclosed system. The opening tool 580 is pivotally mountable using a pivotal element 593*a* (in this arrangement a round aperture mountable on a pin), such that the tip 587 of the opening tool 280 or the levering button 589 is disposed outside of the stowing void 581 within the side wall 518*b*. The biasing member 593*b* is oriented and configured to cause the levering button 589 to be projecting out of the stowing void 581 and away from the side wall when the system is in a state of not being used. When a package is loaded into the system by sliding the package 110 along supporting elements, the levering button 589 automatically is depressed and causes the opening tool 280 to pivot about pivotal fixing 593*a* and the cutting tip 587 and optional blade 585 to be moved out of the stowing void and into the path of the package 110. The weight of the package 110 maintains the opening tools 580 in the use position. As the package 110 is further installed (as is illustrated in FIGS. 10B and 10C), the opening tool 580 engages the weakened area of the opening access 132 and causes the package to be opened for dispensing of articles. Once the package 110 is removed from the system, the biasing member encourages the bladed tip 587/585 to retract into the stowed position and projects the levering button ready for further activation of the opening tool when required. A benefit of this arrangement is that in the embodiments where it is required to provide a sharpened blade opening tool that could cause possible injury, the sharpened blade opening tool is stowed out of harm's way when the system is empty and is only allowed to project from that position when the levering button is deliberately pressed, such as by a package 110 and thus the risk of injury is mitigated.

Figure 11:
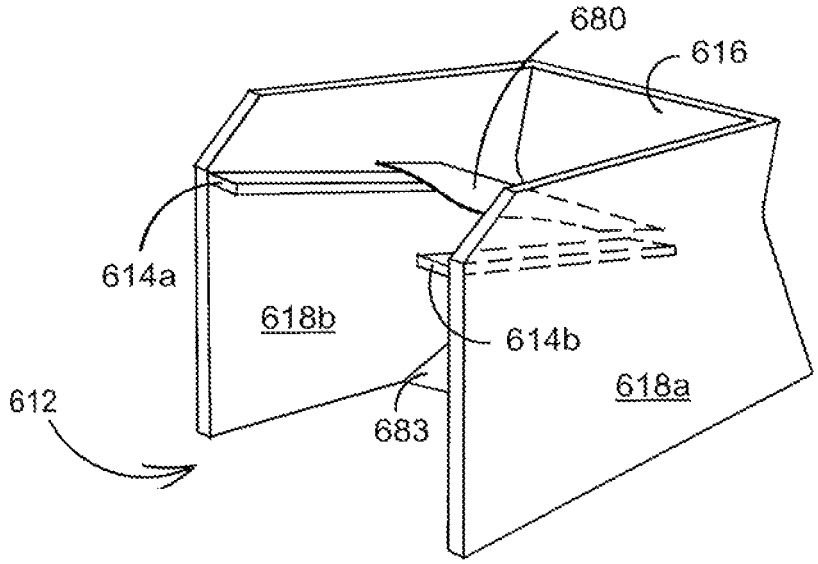
FIG. 11 shows a perspective view of a dispensing system and opening tool according to a seventh embodiment of the disclosure having a single opening tool disposed transversely across and toward the middle of the dispensing system.

A further display and dispensing system 612 suitable for receiving and automatically opening a package 210 is illustrated in FIG. 11 wherein a transverse opening tool 680 extends between side walls 618*a*, 618*b*. The opening tool 680 is shaped such that a leading edge of the opening tool 680 is disposed substantially centrally and is operable to engage a severance initiation point such as aperture 268 for causing further breaking of weakened lines 243, 258*a*, and 256*a* for releasing opening access 232. The opening tool 680 is disposed in vertical and substantially parallel alignment with each of two opposing deck elements or supporting ledges 614*a*, 614*b*.

In one embodiment, the disclosed system 612 is a unitary formation formed as a one piece moulded plastic. Although the system 612 does not comprise a stopping mechanism, in other embodiments a stopping mechanism may be incorporated. In those embodiments where no stopping mechanism is incorporated, a front lip of an in-store shelf may be used to stop articles A from rolling straight out of the system. Likewise, the system 612 may not comprise a base portion, and the store shelf may instead provide a surface onto which articles A dispensed into the lower track are held.

Figure 12A:
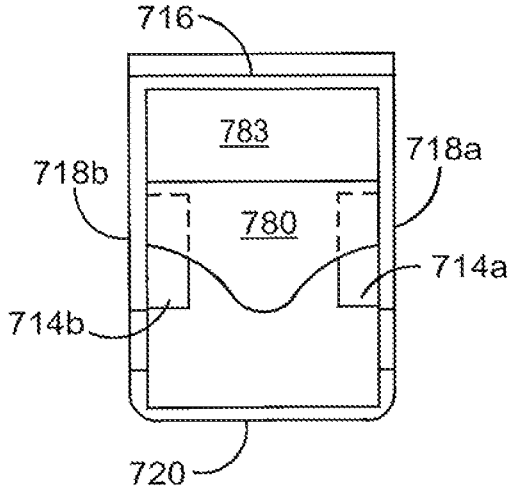
FIGS. 12A to 12C show top, perspective and side views of a dispensing system according to an eighth embodiment of the disclosure having a single opening tool disposed transversely across and toward the front of the dispensing system.
Figure 12B:
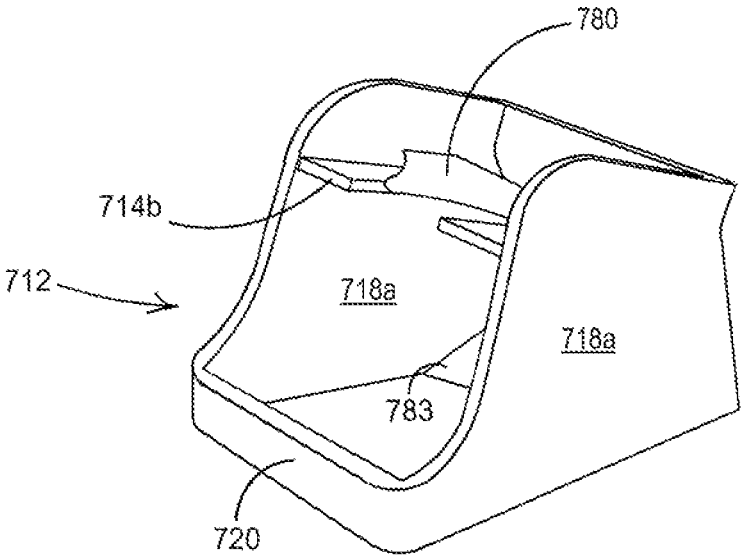
Figure 12C:
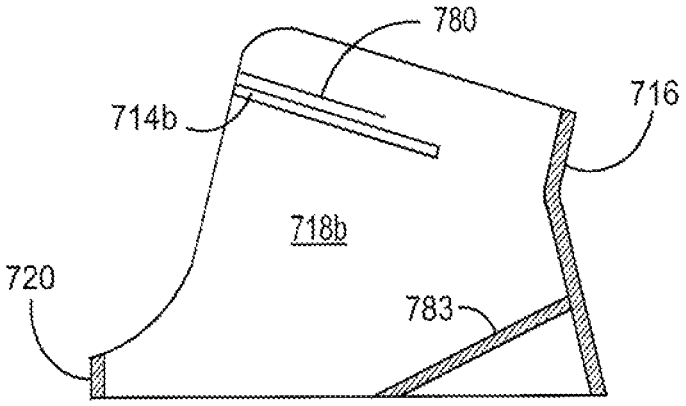

A variation of the system 612 is shown in FIGS. 12A-12C, the difference being that the opening tool 780 is disposed more toward the front of the system 712 rather than in the system 612 wherein the opening tool 680 is disposed toward the middle of the system. The directional references "toward the middle" and "toward the front" are used relative to the positions of the front and back of the systems 612, 712. The precise position of the opening tool 680, 780 is determined by the size of system, size of packages used, size of articles (and hence size of opening access), as well as type of opening access used. A stopping mechanism 720 may be integrally provided as part of system 712. Nonetheless, as described, this stopping mechanism feature is optional.

A further embodiment of the disclosed dispensing system is shown in FIGS. 13A to 13G. The package-opening tool comprises an angled plate 880 disposed, in this illustrated arrangement in close proximity to the front of the system 812. A package is opened by leveraging the weakened part of the opening access of the package about the opening tool 880 as is shown in the accompanying illustrations. The package 210 is first angled so that the severance initiation opening 268 of package 210 is impaled onto the front tip 887 of the opening tool 880; the package 210 is held at an angle similar to that of the opening tool 880 in order to achieve this.

Figure 13A:
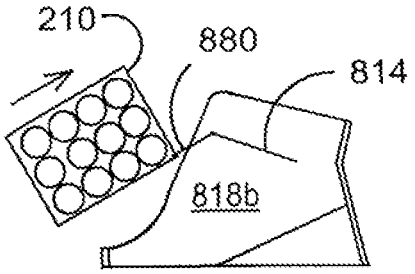
FIGS. 13A to 13G show side and perspective views of a dispensing system according to a ninth embodiment of the disclosure having a front positioned lever opening tool.
Figure 13B:
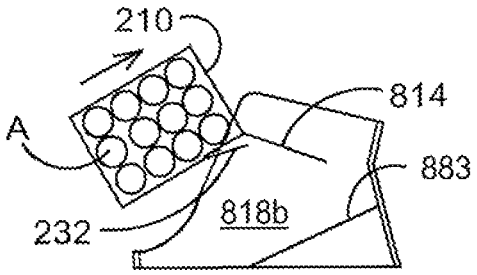
Figure 13C:
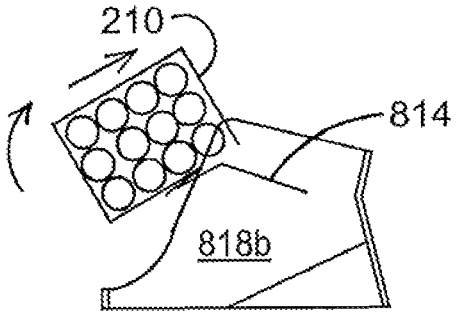
Figure 13D:
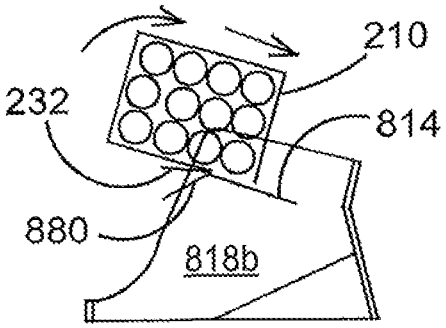
Figure 13E:
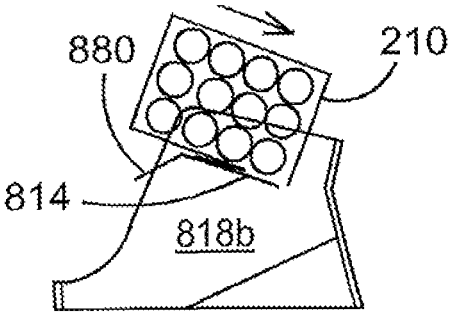
Figure 13F:
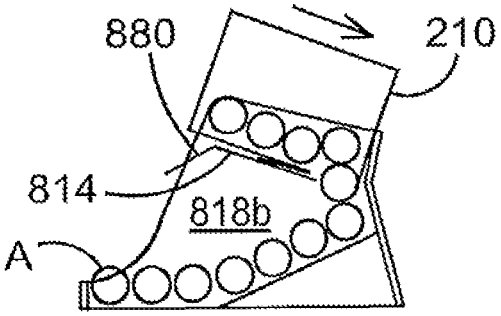
Figure 13G:
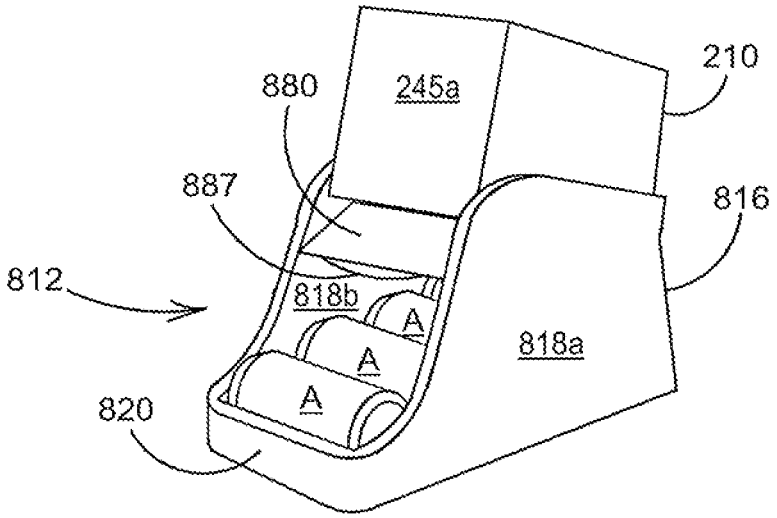

Once the package 210 is fed further onto the opening tool 880 during operation, perforate lines 243, 258*a* and 256*a* are broken to release opening access flap (see FIG. 13B). The opening tool 880 thereafter provides a barrier to prevent early release of articles. Likewise, the deck elements or supporting ledges are disposed across the front and middle parts of the system 812 so that as the package 210 is moved further into the system 812, the opposed supporting ledges 814 provide a barrier to close the opening and prevent premature release of articles A. As the package 210 is further installed, the opening access 232 is folded between the supporting ledges 14 and the bottom of the package 236 (see FIGS. 13C to E). Once the package is fully installed, the opening is aligned with a notional vertical shaft and articles are free to roll out of the package 210 and into the lower track (see FIG. 13F). In some embodiment of the present disclosure, the supporting ledges 814 are not inclined. The opening causes sufficient dislodgement of the articles that nearly all, if not all, of the articles roll out of the package. The slight incline offered by the folded opening access 232 may provide a sufficient forward feeding mechanism to cause the last article to roll out.

Though in the aforementioned embodiments of dispensing system, many of the systems have had a unitary structure or moulded form, it is also envisaged that such dispensing systems can be assembled from a kit of modular parts. FIGS. 14A to 14E show one embodiment of how the disclosed dispensing system may be assembled from a kit of modular parts.

Figure 14A:
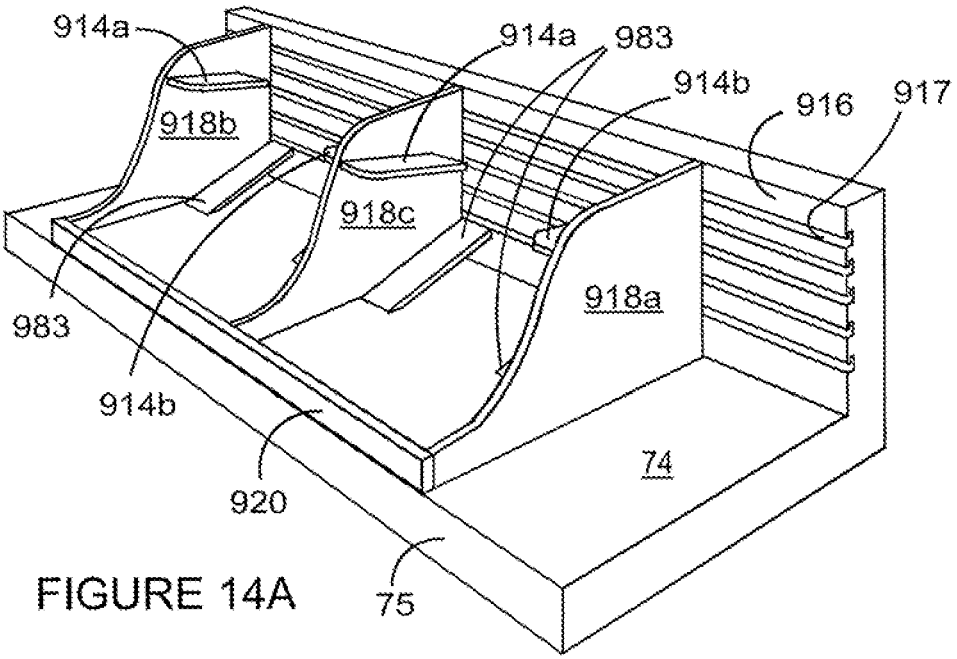
FIGS. 14A to 14E illustrate perspective, front and side views respectively of an exemplary modular system for forming dispensing systems, such as those shown in dispensing system embodiments 1 to 9.
Figure 14B:
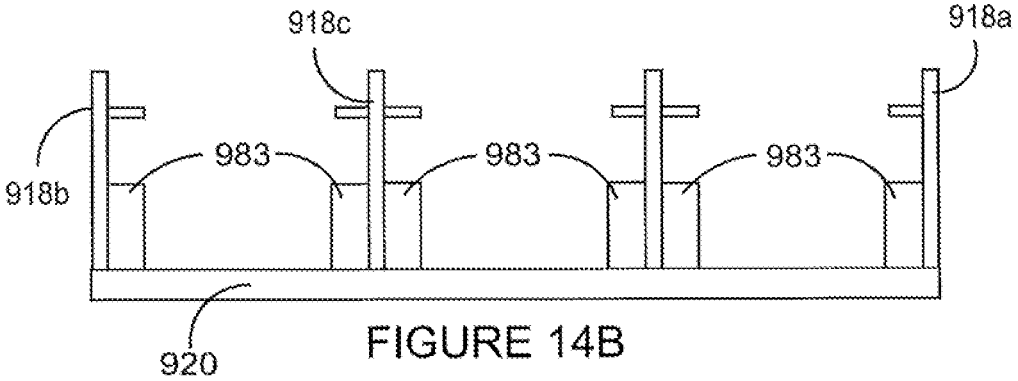
Figure 14C:
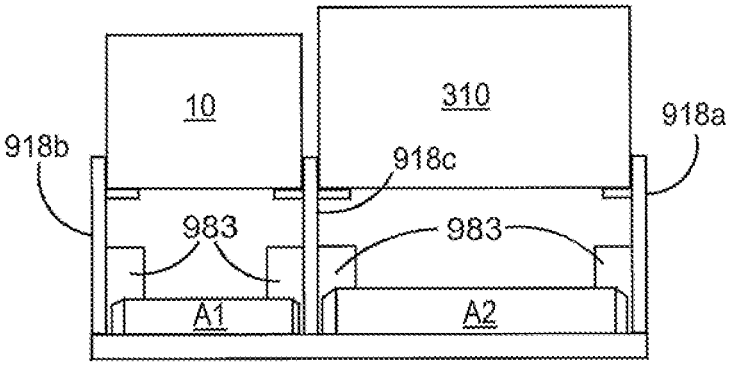
Figure 14D:
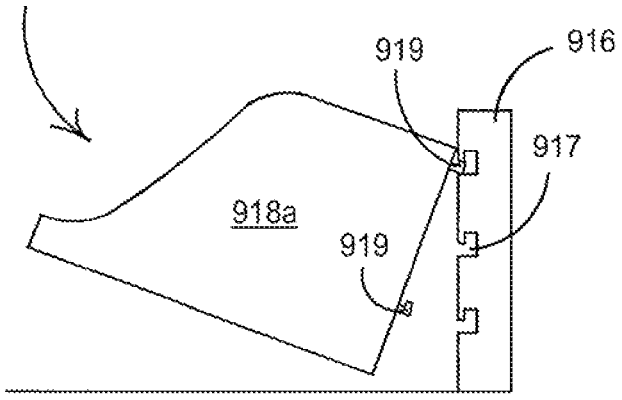
Figure 14E:
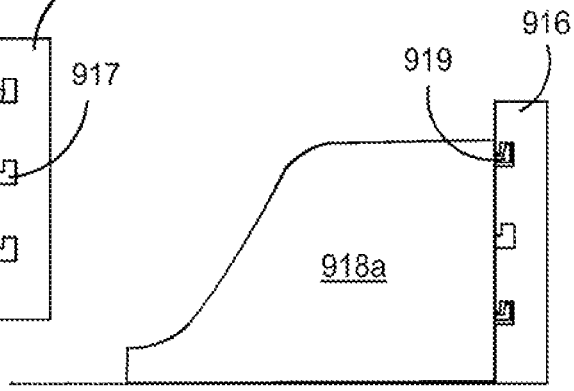

In FIG. 14A, a series of side panels having at least one, optionally inclined, supporting ledge 914*a*, 914, secured thereto and having at least one forward feeding mechanism (optionally a ramp) 983 secured thereto are shown. Middle side panels 918*c* comprise two supporting ledges 914*a*, 914*b* and two ramp elements 983. Right and Left-hand end panels 918*a*, 918*b* comprise only one supporting ledge 914*b*, 914*a* and only one ramp element 983. A stopping mechanism 920 is provided as a separate piece. The side panels are attachable by fixing elements 919 to a back panel 916 (see FIG. 14D and 14E). The back panel 916 comprises a series of grooves, apertures or the like for receiving the peg or hook style fixing elements 919 of the side panels so that the side panels can be removably affixed to the back 916. By providing a series of grooves or apertures along the back 916, a variety of locations are available for attaching side panels 918*a*, 918*b*, 918*c*. Furthermore, in this way the dispensing systems 912 of different widths may be created (see FIG. 14C). This also may be beneficial where it is required to stock and display articles A1 of a first size alongside articles A2 of a second size, and where the dispensing system accommodates packages 10, 310 of different sizes due to the different articles types A1, A2.

A further feature of a modular system is that the opening tools may be removable affixed to the side panels so that, if a package having a different access mechanism is to be stored in the dispensing system, a more appropriate opening tool 980 may be mounted on the dispensing system. In FIGS. 15-19B, five examples of the module 984, 1184, 1484, 1584 onto which the opening tool 980, 1080, 1180, 1480, 1580 is mounted are shown.

Figure 15:
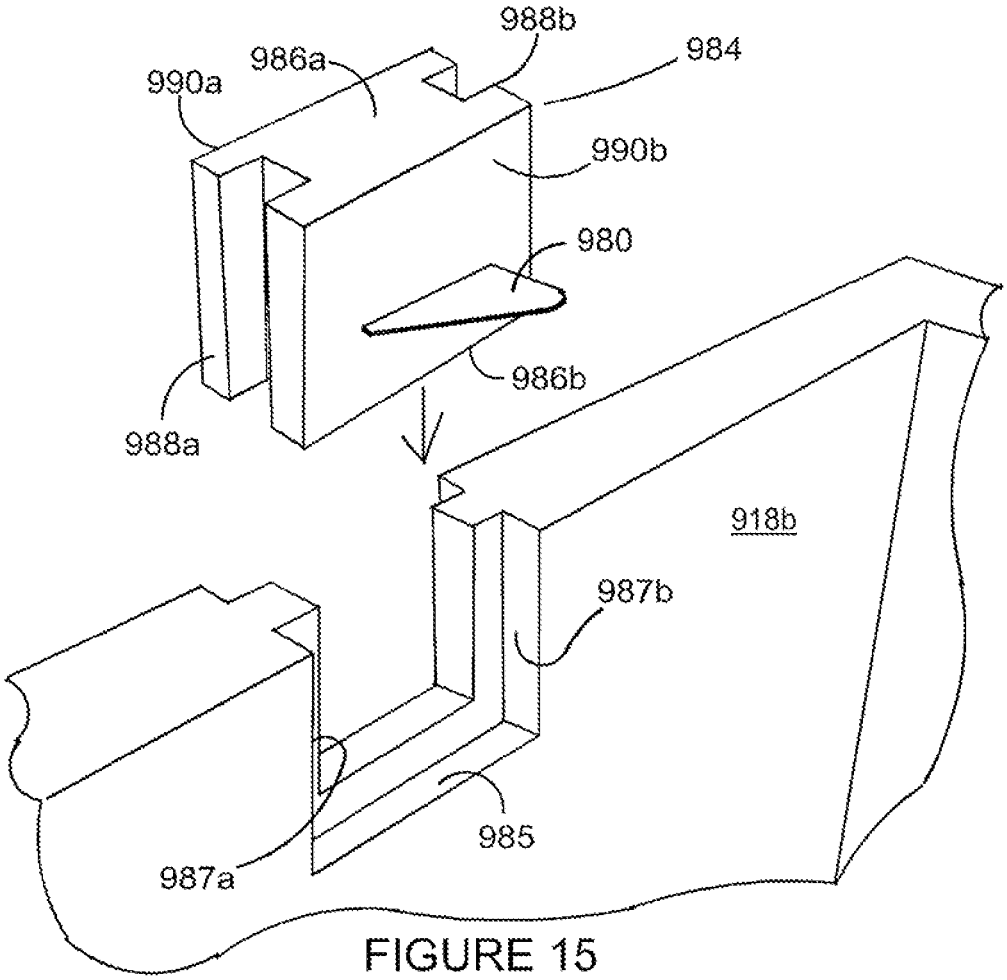
FIG. 15 shows a first exemplary modular fixing for a side positioned cutting tool.

In FIG. 15, the module is 'H'-shaped in cross-section and is received in an 'H'-shaped socket of the side 918*b*. Side edges 988*a*, 988*b* of the tool module 984 are mated using a frictional fit against inner side walls 987*a*, 987*b* of the socket 985. The tool module 984 has front and rear faces 990*b*, 990*a* that are designed to fit physically and aesthetically within the side wall 918*b*. Though the bottom face 986*b* of the tool module 984 cannot be seen once the tool module is installed, the outer top face 986*a* may be formed to match the side panel 918*b* or formed to contrast therewith as required by design considerations. The plug and socket type fit of the tool module with the side wall 918*b* enables a modular formation of the display and dispensing devices and/or a retro-fitting of cutting tools and/or swapping of tools for more suitable tools or replacement tools in case of breakage.

Figure 16:
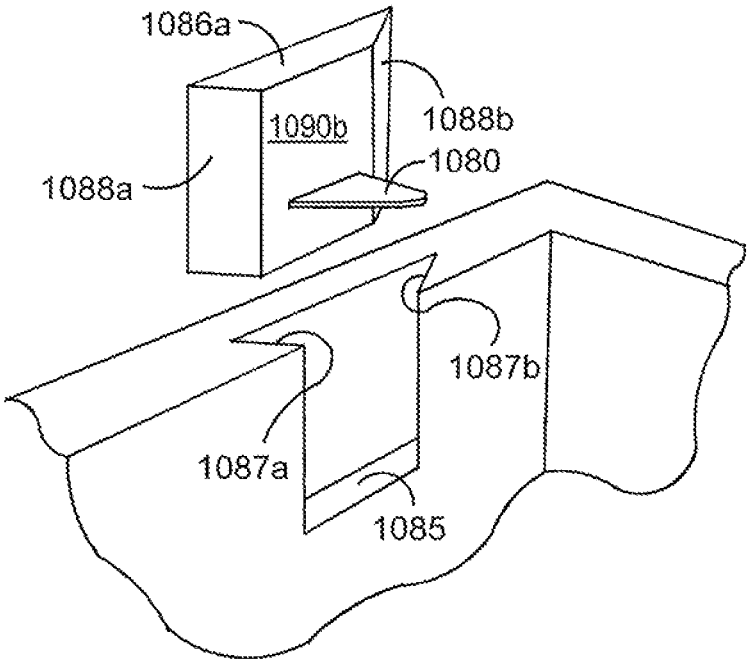
FIG. 16 shows a second exemplary modular fixing for a side positioned cutting tool.

The tool mounting of FIG. 16 is dovetail shaped and slots into a similarly shaped dovetail socket having tapered sides 1087*a*, 1087*b* that match the oblique sides 1088*a*, 1088*b* of the tool module. Again, the front, rear and top faces 1090*b*, 1086*a* of the tool module may be formed to match the colour and texture of the side panel.

Figure 17:
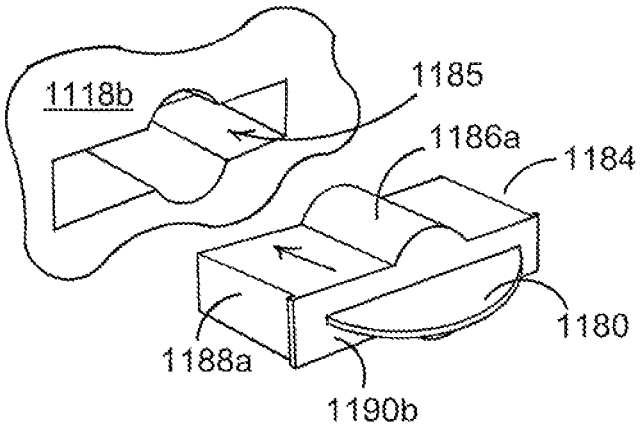
FIG. 17 shows a third exemplary modular fixing for a side positioned cutting tool.
Figure 18:
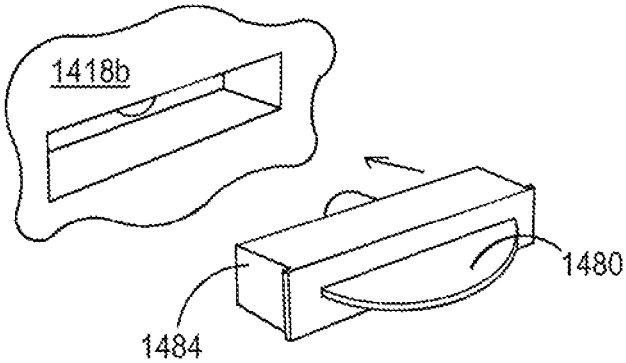
FIG. 18 shows a fourth exemplary modular fixing for a side positioned cutting tool.
Figure 19A:
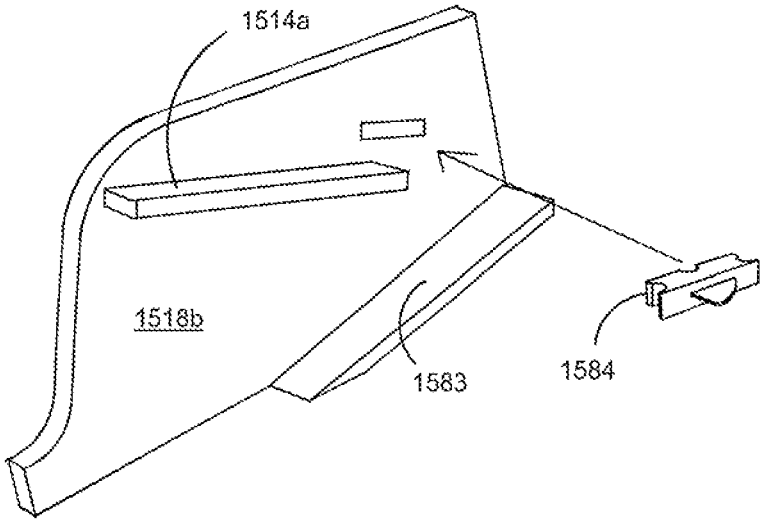
FIGS. 19A to 19B show perspective and cross-section views of a fifth exemplary modular fixing for a side positioned cutting tool.
Figure 19B:
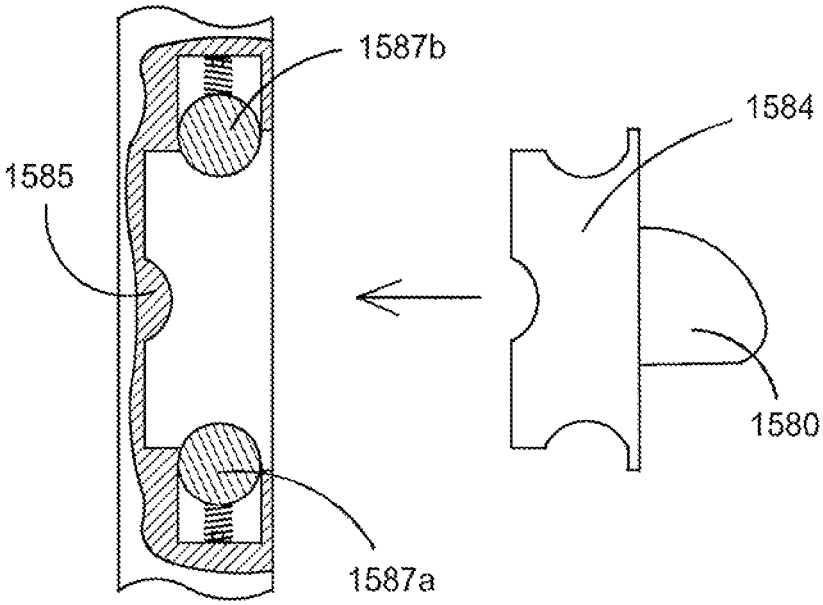
Figure 20:
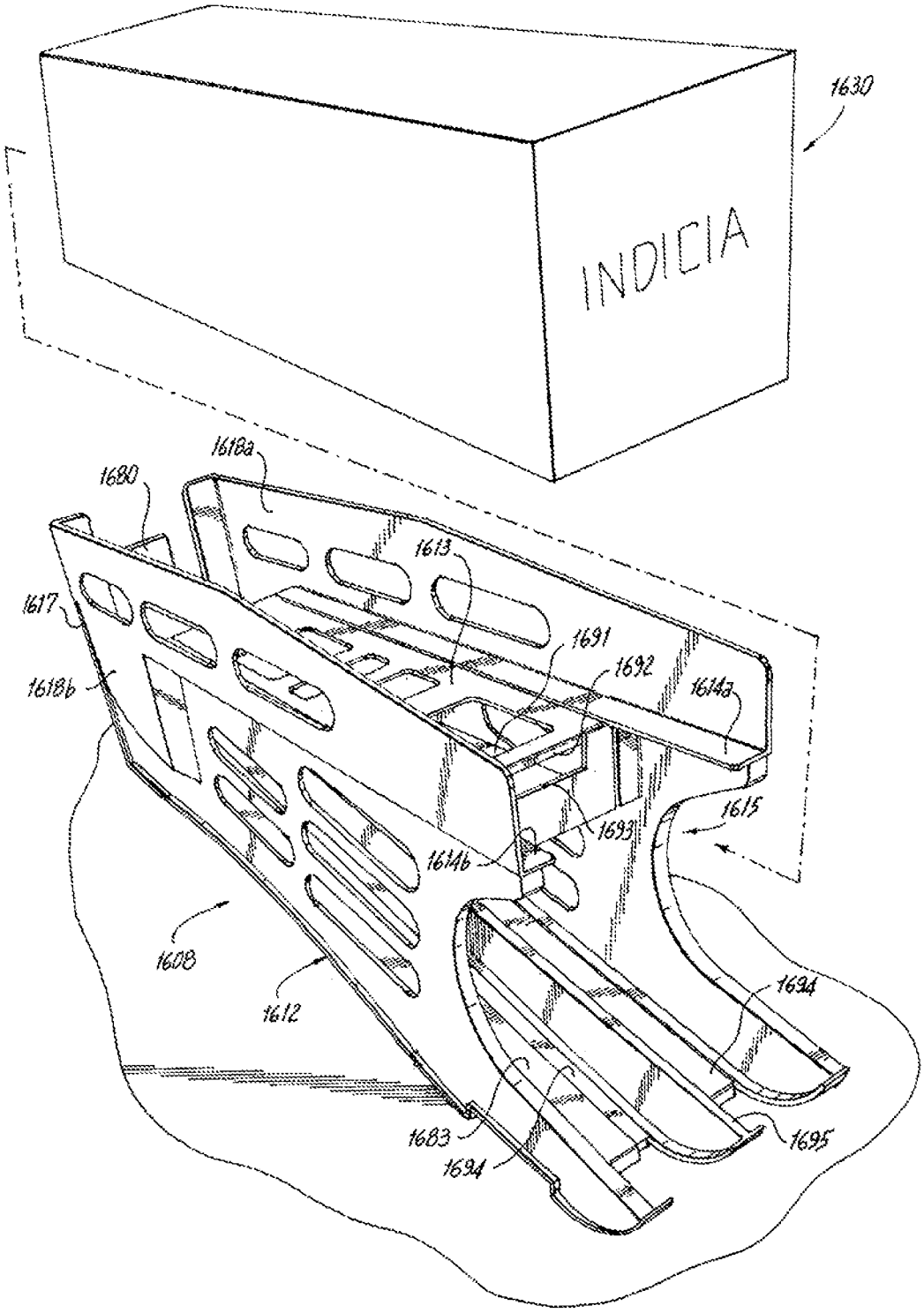
FIGS. 20 and 21 are front and rear perspective views of a dispensing system or frame accordance to one exemplary embodiment.
Figure 21:
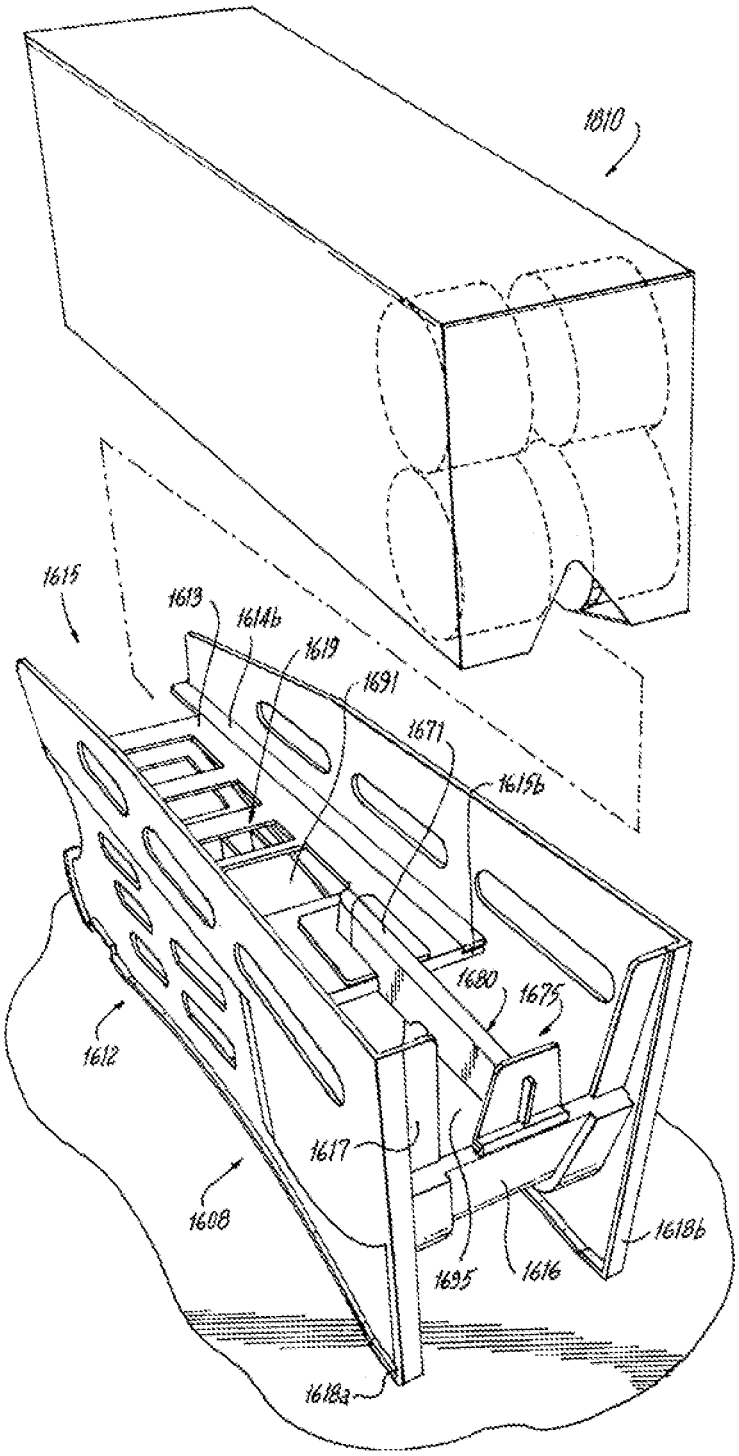

In FIGS. 17 onwards, the tool modules fits transversely into the body of the side wall rather than slotting downwardly into the sides. The plug and socket mechanisms discussed may have many and various complimentary formed fittings compared to that shown. In FIG. 19B, a socket mechanism has sprung biased balls and a tool module having arcuate mating portions is realisably held within the socket.

FIGS. 20 to 31 illustrate the disclosed dispensing system that has been constructed in accordance with yet another embodiment of the present disclosure.

Figure 25:
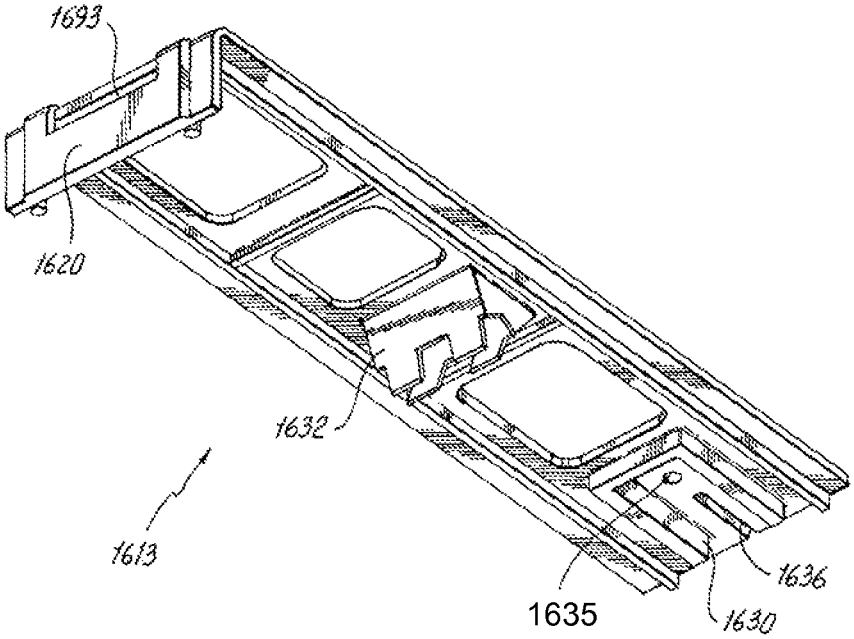
FIG. 25 is a perspective view taken from below of a floor member used in the dispensing system of FIGS. 20 and 21.
Figure 26:
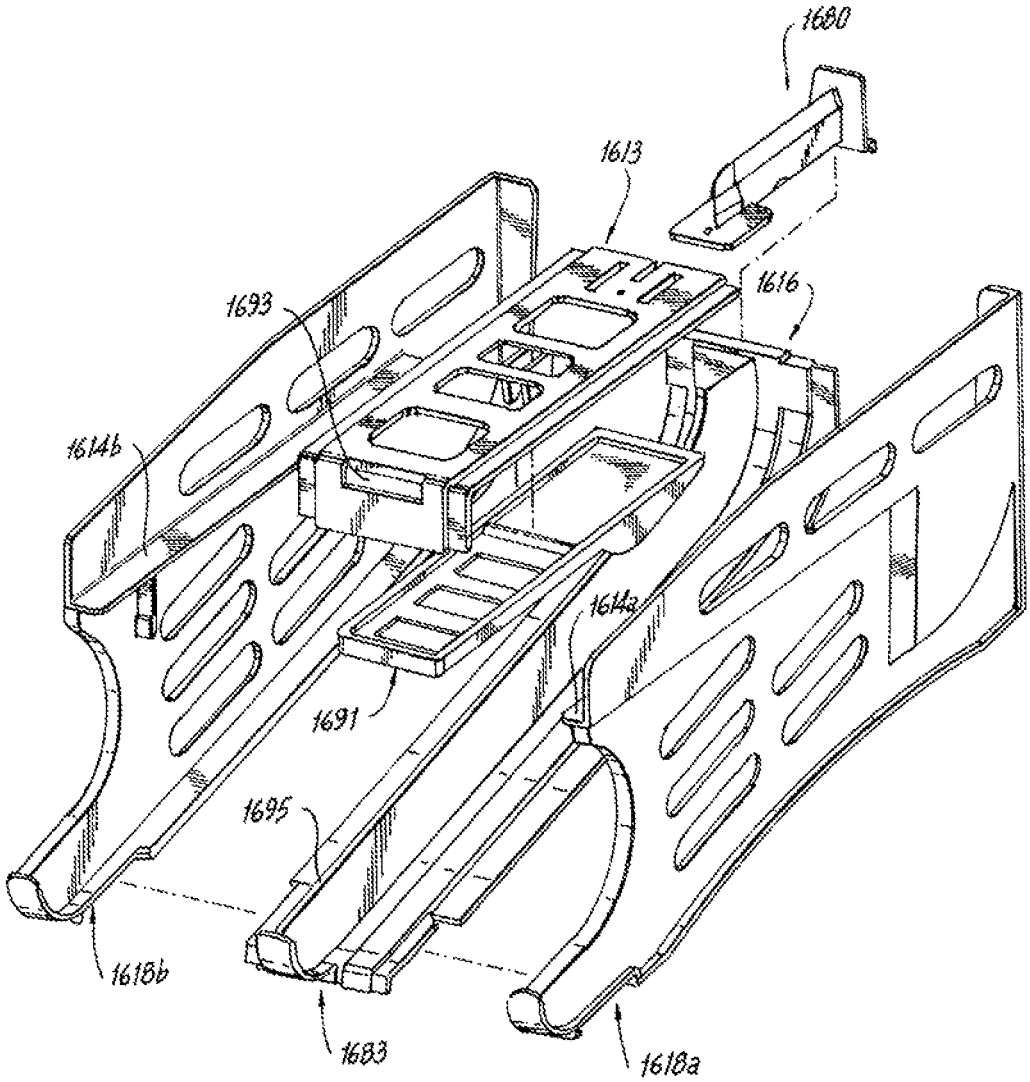
FIG. 26 is an exploded perspective view of the dispensing system or frame used in the dispensing system of FIGS. 20 and 21.
Figure 27:
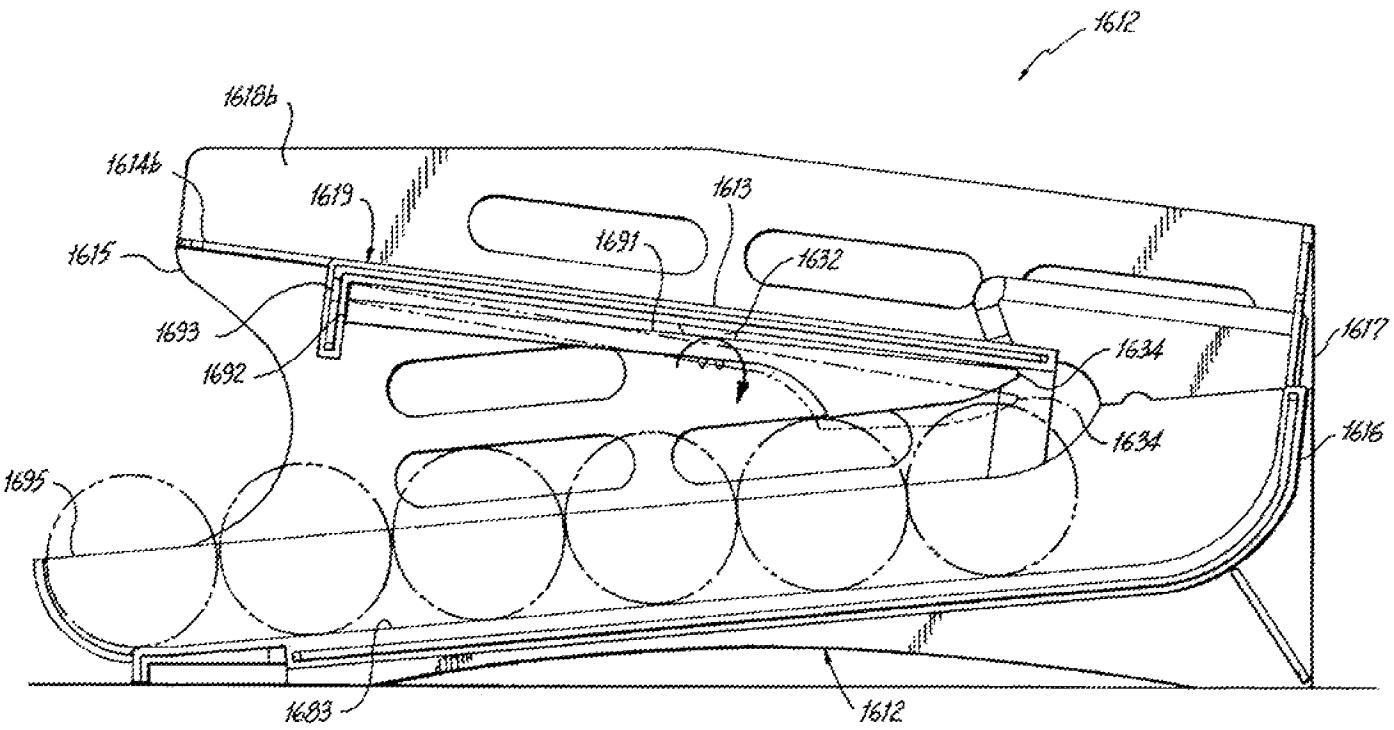
FIG. 27 provides a cross-sectional view of the dispensing system of FIGS. 20 and 21 which illustrates the pivoting movement of the flag element.

FIGS. 20 to 27 provide various views of dispensing system 1608, including front and rear perspective views of the system (FIGS. 20 and 21, respectively), perspective views of various component parts which make up the dispensing system (FIGS. 22-25), an exploded perspective view of the dispensing system (FIG. 26), and a cross-sectional view of the dispensing system (FIG. 27).

Similar to the previously described embodiments, the disclosed dispensing system 1608 includes a frame 1612 and an opening tool 1680.

The frame 1612 includes:

(a) laterally opposed side walls 1618*a*/1618*b* extending between the front end section 1615 of the frame and the rear end section 1617 of the frame; and (b) an upper support deck 1619 extending at least partially between the front and rear ends 1615/1617 and below which a product display area is provided.

The upper support deck 1619 is formed in part by laterally opposed rails 1614*a* and 1614*b* of side walls 1618*a*/1618*b*.

The laterally opposed side walls 1618*a*/1618*b* are adapted and configured for guiding a package as it is moved longitudinally along the upper support deck 1619.

A floor member 1613 extends between the rails 1614*a*/1614*b* and forms the remainder of the upper support deck 1619. As shown in FIG. 25, floor member 1613 includes a front panel 1620 that can have product related indicia printed, etched or formed thereon or can include structure for holding product related indicia or material, including but not limited to, coupons. Front panel 1620 of floor member 1613 has a viewing window 1693 formed therein, the purpose of which will be described herein below.

The underside of floor member 1613 also includes fulcrum member 1632 which includes a female engaging member into which a corresponding male feature 1676 formed on the topside of the flag element 1691 is inserted. As a result, the flag element 1691 is capable of pivoting about the fulcrum member 1632, the purpose of which will be described herein below.

Frame 1612 also includes a base panel or lower display deck 1683 and a rear wall 1616 which is configured to guide articles to the product display area. As best shown in FIGS. 26 and 27, the interior surface of rear wall 1616 defines a ramp or curved surface which assists the transition of the dispensed articles to the product display area. Moreover, lower display deck 1683 includes a lane divider 1695 which establishes two product distribution channels within the lower display area of the frame 1612.

Figure 22:
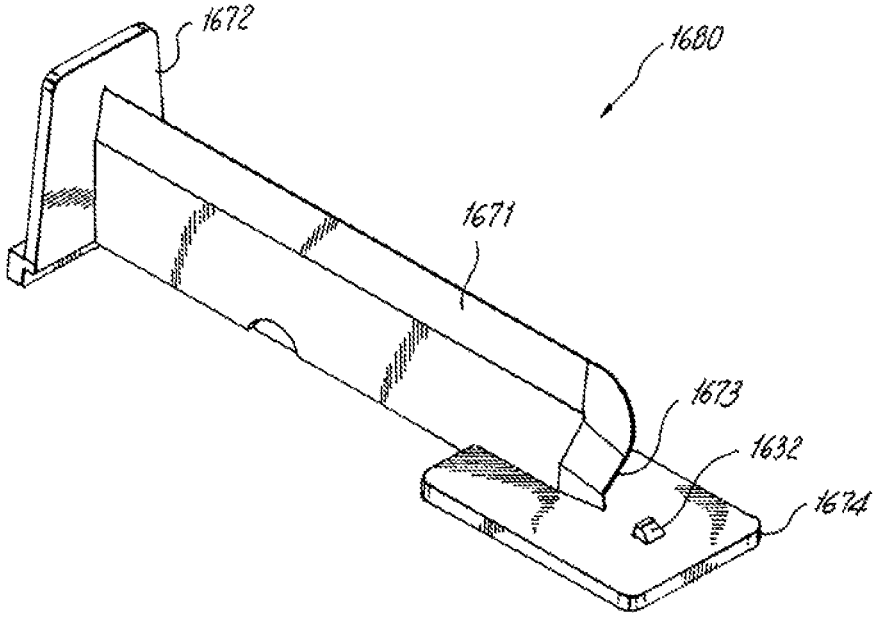
FIG. 22 is a perspective view of an opening tool for the dispensing system of FIGS. 20 and 21.
Figure 23:
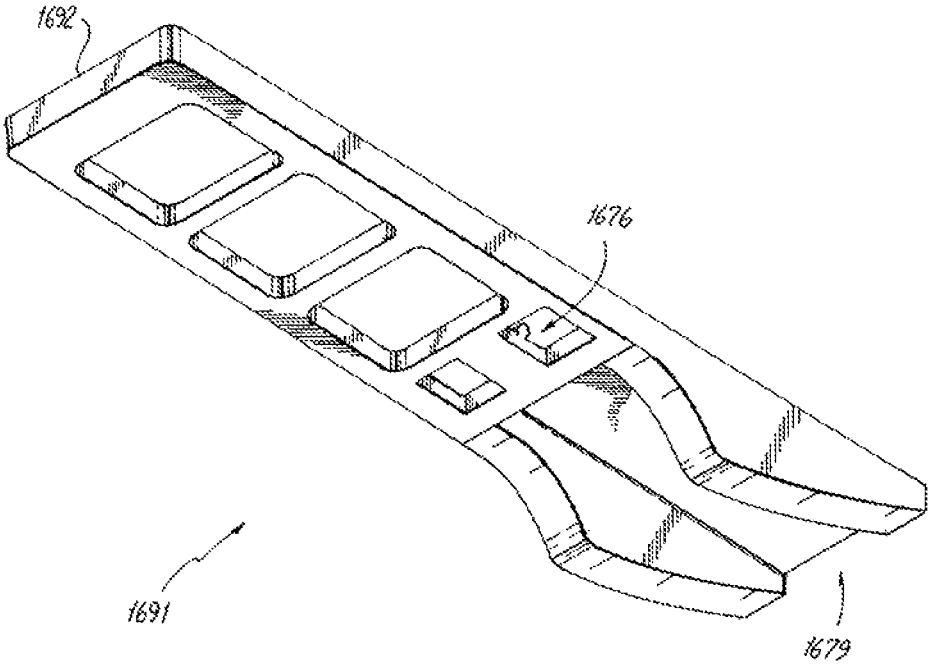
FIG. 23 is a perspective view of a flag element for the dispensing system of FIGS. 20 and 21.

FIG. 22 provides a perspective view of one embodiment of the opening tool 1680. Opening tool 1680 has an upwardly projecting cutting or severing panel 1671 which extends between a mounting tab 1672 and a tongue member 1674. The cutting panel 1671 is provided with a forward edge 1673, which, as will be discussed in detail below, is adapted for cutting or severing a package as it is slid along the upper support deck 1619.

Mounting tab 1672 is adapted and configured to snap into a corresponding socket formed in the rear wall 1616 of frame 1612. As shown in FIG. 26, tongue member 1674 is inserted into a channel 1630 formed on the underside of the floor member 1613. The channel 1630 is best viewed in FIG. 25. A protuberance 1632 is provided on an upper surface of tongue member 1674, which engages within a recess 1635 formed on the underside of the floor member 1613 and thereby secures the tongue member 1674 with channel 1630. The floor member 1613 is also provided with a slot 1636 into which the forward end or edge 1673 of cutting panel 1671 is inserted.

Figure 24:
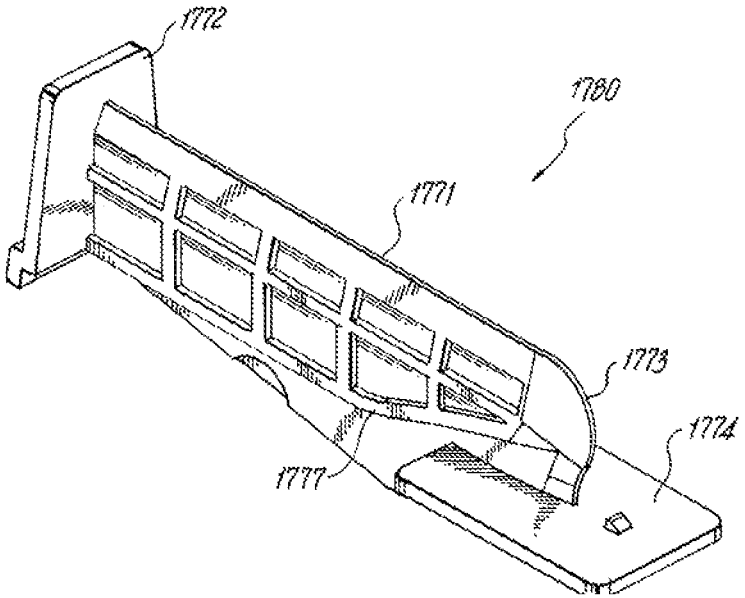
FIG. 24 is a perspective view of an opening tool for the dispensing system of FIGS. 20 and 21.

FIG. 24 illustrates a further embodiment of an opening tool that can be used in display device 1608 and has been designated as reference numeral 1780. Like opening tool 1680, opening tool 1780 includes an upwardly projecting cutting or severing panel 1771 which extends between a mounting tab 1772 and a tongue member 1774. The cutting panel 1771 is provided with a forward edge 1773 which, as will be discussed in detail below, is adapted for cutting or severing a package as it is slid along the upper support deck 1619.

Opening tool 1780 is secured in a similar fashion as opening tool 1680 to frame 1612 using mounting tab 1772 and tongue member 1774. However, unlike opening tool 1680, the severing panel 1771 of opening tool 1780 includes laterally opposed guide ribs 1777 (near side shown) formed on each side of the panel. The guide ribs 1777 are adapted and configured to guide or urge the opening access 1878/1879 associated with package 1810 to open outwardly and not inwardly.

FIG. 27 provides a cross-sectional view of frame 1612. In this figure, it is readily apparent that the upper support deck 1619 and the lower deck 1683 of the frame 1612 are arranged at an angle with respect to horizontal. The upper support deck 1619 slopes in a downward direction from the front end 1615 to the rear end 1617 of the frame, while the lower deck 1683 slopes downward in the opposite direction. As discussed previously, this arrangement allows gravity to be used to move the articles from within the package down into the lower display area and towards the front end 1615 of the frame 1612 where they can be accessed by consumers.

Figure 28:
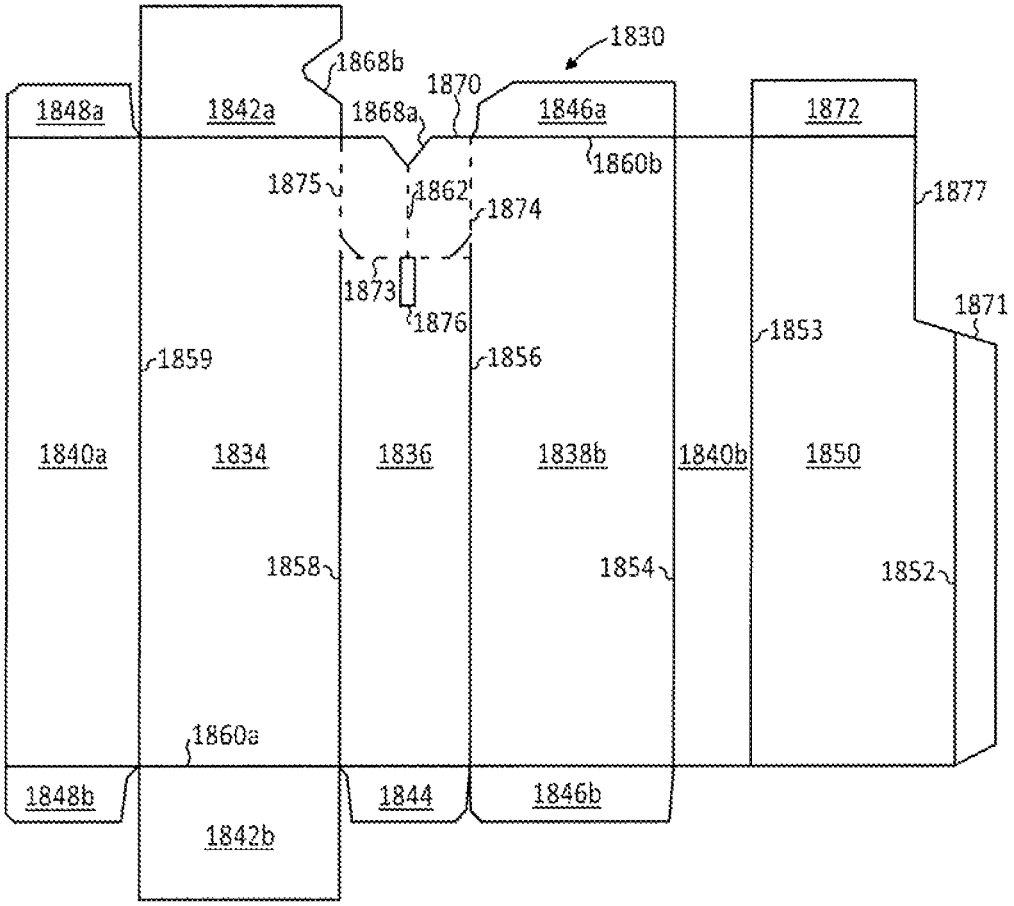
FIG. 28 shows one embodiment of a blank for forming a package suitable for use with dispensing systems shown in FIGS. 20 and 21.

FIG. 28 shows one embodiment of the blank 1830 suitable for a construction of package 1810. The blank 1830 includes a bottom panel 1836, a first side panel 1834, a second side panel 1838, an outer top panel 1840*a*, an inner top panel 1840*b*, a center panel 1850, and a glue flap 1871. These panels hinged together in series along fold lines 1852, 1853, 1854, 1856, 1858, and 1859. The blank also includes end flaps 1848*a-b*, 1842*a-b*, 1844, 1846*a-b* and 1872.

Bottom panel 1836 of the blank 1830 has a first longitudinally extending severance line 1862 positioned about its centerline which extends from a severance initiation notch 1868*a* to a second laterally extending severance line 1873. Moreover, fold lines 1874 and 1875 are provided on the lateral edges of the bottom panel 1836. Two triangular cutouts and a rectangular cutout 1876 have been provided in bottom panel 1836. End closure flap 1842*a* includes a severance notch 1868*b* and center panel 1850 includes a notch 1877, the purpose of these features will be discussed herein below.

Figure 29:
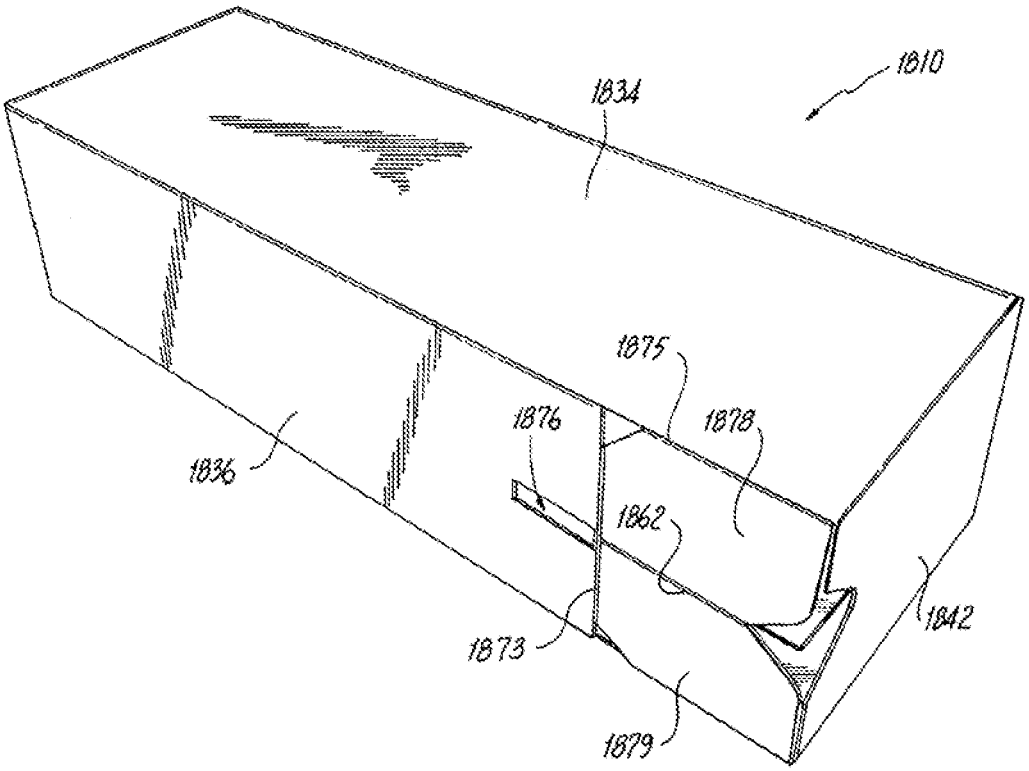
FIG. 29 is a perspective view showing the bottom of the package which has been constructed using the package of FIG. 28.
Figure 30:
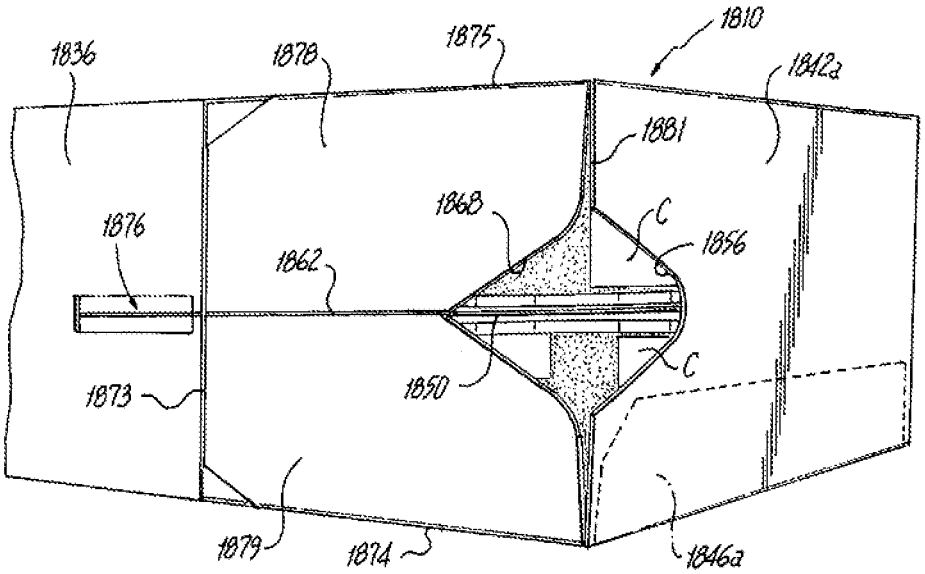
FIG. 30 is a close-up perspective view of the hinged doors formed in the bottom of the package of FIG. 29.
Figure 31:
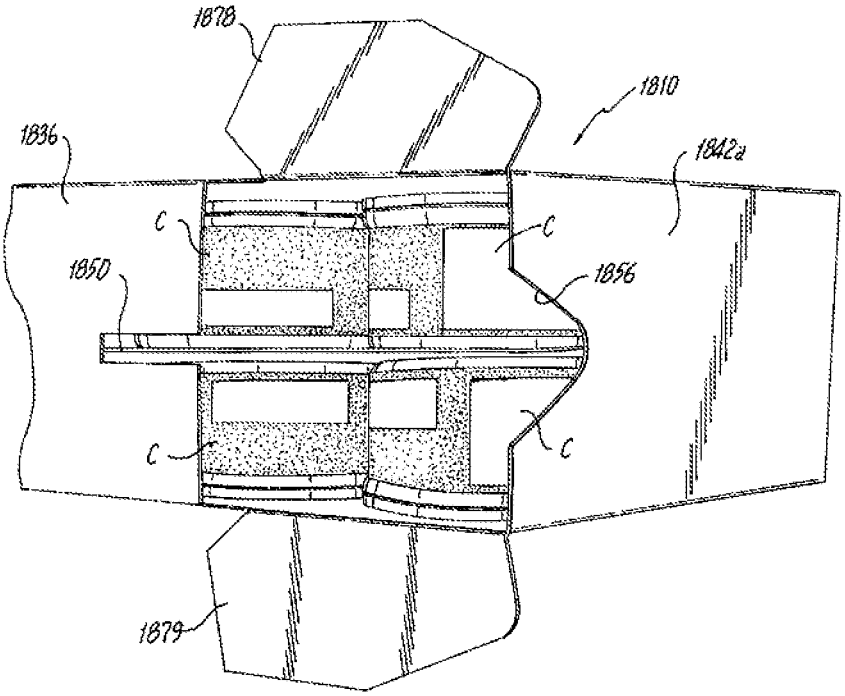
FIG. 31 is a close-up perspective view of the hinged doors formed in the bottom of the package of FIG. 29 shown in the open position.

Blank 1830 is foldable along lateral fold lines 1860*a-b* and longitudinal fold lines 1852, 1853, 1854, 1856, 1858, and 1859 into a package 1810 that has two longitudinally extending compartments separated by center panel 1850. As described with respect to previous embodiments, the end closure flaps 848*a-b*, 1842*a-b*, 1844, 1846*a-b* and 1872 may be secured in overlapping, face contacting relationship using adhesive or other suitable securing techniques. FIGS. 29 and 30 provide perspective views taken from below of the assembled package 1810. FIG. 31 shows the package 1810 after the severance lines 1862 and 1873 have been cut, so as to create opening access 1878 and 1879.

Figure 32:
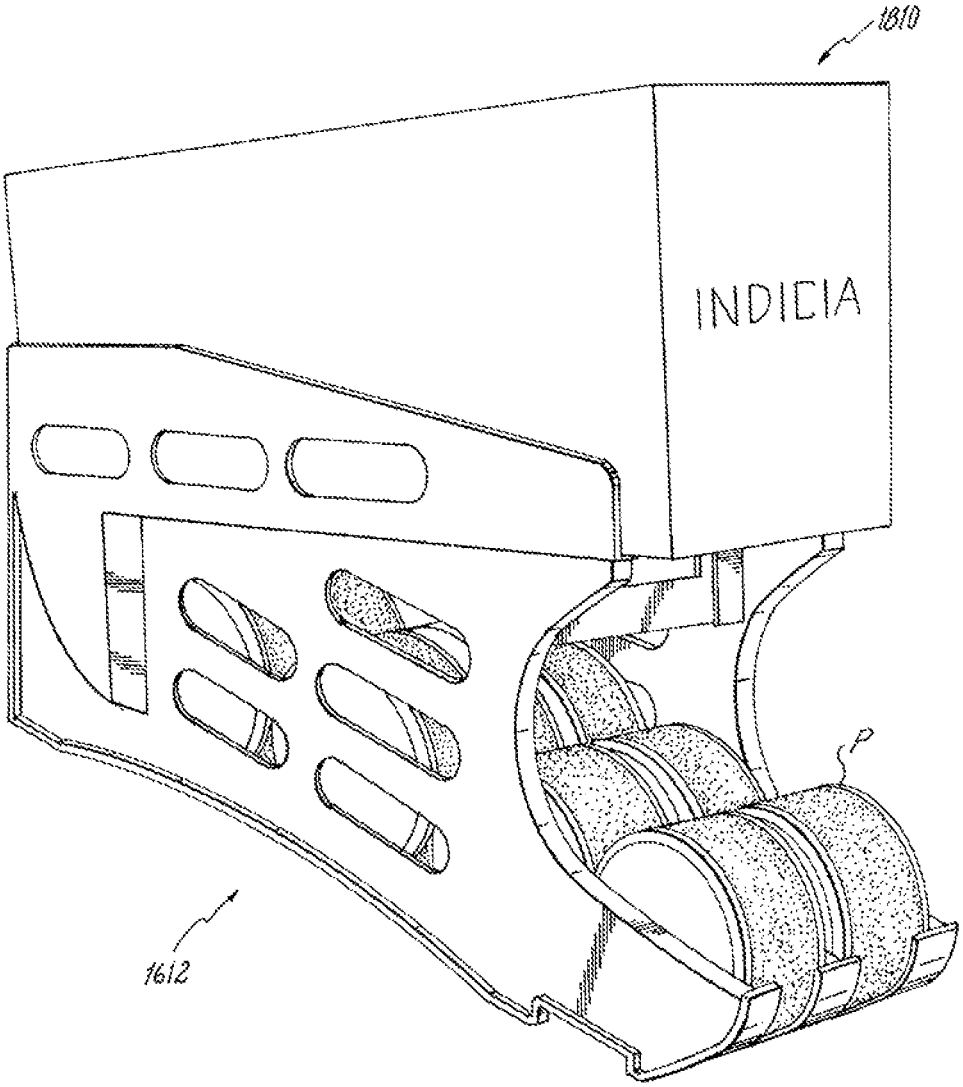
FIG. 32 provides a perspective view of a dispensing system that includes the dispensing system of FIGS. 20 and 21 and the package of FIG. 29.

In use, package 1810, which is filled with two rows of articles "P", is placed onto the front end of the upper support deck 1619 of frame 1612. Then the package 1810 is slid longitudinally towards the rear end 1617 of the frame 1612 until the forward edge 1673 of cutting panel 1671 is received within severance notches 1868*a-b* of the package 1810. Further, longitudinal sliding of the package causes the opening tool 1680 to sever initially the first longitudinal severance line 1862 and then the second lateral severance line 1873. FIG. 32 shows the arrangement where package 1810 has been moved into contact with back or rear wall 1616 of the frame 1612, and the opening access 1878/1879 formed in the bottom panel 1836 have been opened; thereby allowing at least a portion of articles P to dispense from the package 1810 onto the lower display deck 1683 and into the lower display area.

Referring now to FIG. 27 which provides a cross-sectional view of frame 1612 and illustrates a method of indicating whether the dispensing and display system is near empty and therefore a new package should be loaded onto the upper support deck 1619. As shown therein, the flag element 1691 is mounted on fulcrum member 1634 and can pivot between a first position, shown using solid lines, and a second position, shown using dashed lines. When a sufficient number of products are stored in the lower display area, the tail end 1634 of the flag element 1961 contacts at least one product and is raised. As a result, the front face 1692 of the flag element 1691 is lowered and the flag element 1691 is in the first position. When the dispensing and display system nears empty, the tail end 1634 of the flag element is not in contact any products and therefore the flag element 1691 moves to the second position in which its front end 1692 is raised and is visible through the viewing window 1693 provided in the front panel 1620 of the floor member 1613. The front end 1692 of the flag element 1691 can be painted red, for example, in order to provide a visual indication in the viewing window 1693 that the display and dispensing system is near empty. Those skilled in the art would readily appreciate that other methods for indicating that the system is near empty can be employed without departing from the inventive aspects of the present disclosure.

It can be appreciated that various changes may be made within the scope of the present disclosure, for example, the size and shape of the panels and apertures may be adjusted to accommodate articles of differing sizes or shapes. Where as many embodiments of the disclosure have been illustrated using cartons containing twelve articles disposed in a 4×3 array, it is envisaged that in other embodiments of the disclosure the packages or cartons contain a greater or lesser number of articles than twelve and the articles are arranged in any suitable configuration such as a 2×6 array.

Furthermore, though the disclosure has been described in the contact of a paperboard carton and plastic dispensing device, in other embodiments of the disclosure it is envisaged that other suitable foldable sheet material may be used for forming the package (such as cardboard, plastics material and the like) or that the carton or magazine for articles may formed as a reusable dispenser with a reusable opening mechanism. Additionally, the dispensing device may be formed from other materials or combinations of materials for example: metal, wood, fibre glass, glass-reinforced plastic.

The carton 10, 110, 210 may take various forms. In the above disclosure, detailed description and illustration of three different and exemplary cartons 10, 110, 210 are provided (see FIGS. 3A-3D; 5A-5D and 8A-8D). Each of these cartons 10, 110, 210 is a fully enclosed carton of the end loading type, however, it will be understood that the benefits described herein can be obtained by using other types of cartons, for example, partially enclosed cartons; top-loading cartons; trays; and wraparound cartons as non-exhaustive examples.

Though the articles illustrated are either bottles (FIGS. 1A-2) or cans (FIGS. 7A-7C & 13A-13G), the disclosure is applicable to a wide variety of products contained in various containers. When desired, the containers may have at least a cylindrical portion to encourage rolling of the articles from the carton through the lower level of the display device and into the dispensing position. However, the dispensing device apparatus of the present disclosure is applicable to other types and/or shapes and/or sizes of articles. Nonetheless, where advantage cannot be taken of the gravity and rolling to provide the forward feed mechanism, other devices may be provided, for example: a sprung biased mechanism or other suitable means.

It is also envisaged that the packages in other embodiments are provided with a means for detecting when the package is empty of articles without having to lift or too closely inspect the carton. Such means for detecting when the carton is empty of articles may take the form of a window, i.e. an aperture or shaped cut-out in the carton. Such a window may be disposed close to the bottom of the package so that the presence or absence of articles in the lowermost tier of the carton can be detected by observation. In some embodiments, the window could be provided by piece, strip or section of clear, transparent or translucent material, such as plastic sheet to enable the interior of the carton to be viewed, yet maintaining the structural integrity and barrier to dust etc of the carton. Alternatively, an inspection hole or aperture may be provided into which a pen or other instrument could be inserted in order to feel for the presence of articles in the lowermost row.

Whereas cutting elements shown in the illustrated examples may have been shown in a fixed position, these fixed cutting elements alternatively could be provided with means for enabling the cutting elements to be retracted, such as the retractable means shown in FIGS. 10A and 10B. The retractable mechanism described herein provides an exemplary format of a mechanism suitable for enabling a package opening arrangement to be retracted into a stowed position. The shape of the tool, shape of the levering button, the shape of the pivotal fixing and shape of the biasing member could be varied in other embodiments from that shown. It will be understood that the mechanism described and illustrated is one example only and this aspect of the disclosure can be variously employed without requiring the particular shapes, materials, configurations and sizes shown herein.

Whereas reference has been made to inclined ramps 283, inclined grooves 7*a*, 7*b*, and the support element 14*a*, 14*b* being inclined, it will be understood that these features act individually or in combination to provide a forward feeding mechanism that encourages articles that have been dispensed from the carton or package to roll out of the package, onto the lower tier or lower track and then toward the front-end of the lower track. Such a forward feeding mechanism takes the form of an inclined surface or groove where the forward feeding mechanism utilizes the force of gravity and hence the articles suitable for being dispensed in this manner have a rounded portion (i.e. jars, bottles, cans, rounded yoghurt pots, conical articles, and lipsticks as examples). It will be understood that in taking advantage of a gravity feed mechanism that the forward feed mechanism may be provided in a number of ways using ramps, grooves and even features integral to the package itself (for example an internal ramp disposed within the package to encourage the front lower most article to roll toward the access opening would alleviate the need for the supporting element itself to be inclined). The following described examples of the forward feeding mechanism being provided by the supporting element being arranged at an inclined angle relative to a lower plane of the lower track, and/or by an inclined floor of the lower track and/or by the back being scoop-shaped or suitably shaped to encourage forward rolling of articles and/or by one or more ramps extending at an inclined angle from the back toward a lower plane of the lower track are mere examples. In other applications, the articles may not be rounded and the force of gravity may need to be supplemented with an additional or alternative mechanism to encourage articles to be fed-forward to the front-most dispensing position. Such additional or alternative mechanism could be provided by a biasing member; a piston or plunger as examples.

Reference has been made to cutting element, opening tool and package opening device to cover the element of the dispensing system that engages with a package installed in the system to break weakened areas of that package for causing an opening to be created. As such cutting element may not actually have a sharpened blade capable of slicing through material, but rather may be an abutment or projection that is positioned to co-operate with the pre-formed weakened area of a package to cause the breaking of perforations when the package is pushed against the cutting element. In some embodiments, a bladed element or sharpened blade may be provided. In other embodiments, cutting element is taken to mean any projection or obstacle that interacts or engages with the package as that package is installed to break open that package. The opening tool/cutting elements may take a variety of shapes, sizes, positions, numbers and be formed from a variety of materials in other envisaged implementations of the disclosure and therefore the opening tool should not be taken to be limited to only those illustrated and described herein.

Whereas in the illustrated embodiments, the opening tool co-operates with the opening tool by causing part of the opening tool to be broken, as the opening tool is pushed or slidably installed into the dispensing system, it is envisaged that in other embodiments the opening tool provided will co-operate with the opening tool to cause an opening to be created by causing the package to be maintained stationary or substantially motionless. For example, in another envisaged embodiment, the package comprises an outer sleeve and an inner packaging component (e.g., an inner tray, drawer or tubular structure) having an open bottom that is sealed by the presence of the outer sleeve. One or more opening tools provided on the system are insertable into the inner packaging component and thereby hold that inner carton component substantially stationary. The outer sleeve is then moved relative to the inner packaging component, by pulling, or pushing for example, to cause sliding movement of the outer sleeve relative to the inner packaging component and thereby exposing at least part of the bottom opening of the inner component so that articles can be dispensed therefrom. In this manner, the opening tool does not necessarily directly cause a cutting or breaking of the package in order for an access opening to be created for the package. The opening tool does interact with the package to cause opening of the package whilst the package is installed in the dispensing system. In one embodiment, it is envisaged that the opening device is formed as a pair of hooked pins, each insertable into an aperture or weakened tab of the inner packaging component to engage that component. The outer sleeve has a pair of apertures or slots aligned with the aperture or weakened tab of the inner packaging component to allow for easy insertion of the opening tool into the inner packaging component. The outer sleeve may be affixed or adjoined in some manner (such as by adhesive or by a panel) that is broken by the relative movement between the inner packaging component and outer sleeve to allow the opening in the bottom of the inner packaging component to be exposed for dispensing articles.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the disclosure.

We claim:

1. A system for dispensing a plurality of articles each having an article diameter, comprising:

a frame comprising longitudinally opposed front and rear end sections and a sloping upper support deck extending at least partially between the front and rear end sections, sloping downward from the front end section toward the rear end section, and below which a product display area is provided;

a package containing the plurality of articles, the package comprising:

a base wall;

a first side wall;

a second side wall; and wherein the first side wall and second side wall extend from the base wall and are connected to the base wall along opposed longitudinal side edges of the base wall;

the upper support deck in contact with the base wall; and an opening tool associated with the frame and arranged to automatically create an opening in the base wall through which to at least partially dispense the articles from the package into the product display area when the package is moved longitudinally along the upper support deck from the front end section to the rear end section;

wherein the opening tool creates the opening by cutting a severance line proximate to and parallel with a first one of the opposed longitudinal side edges, the package after first contacting the opening tool traveling further along the upper support deck by at least a distance equal to the article diameter; and wherein the articles are dispensed through the opening when the opening is located rearward of the opening tool.

2. A method of dispensing a plurality of articles each having an article diameter, comprising steps of:

providing a frame having longitudinally opposed front and rear end sections and comprising an upper support deck extending at least partially between the front and rear end sections and below which a product display area is provided;

providing an opening tool associated with the frame;

providing a package containing the plurality of articles, the package comprising:

a base wall;

a first side wall;

a second side wall; and wherein the first side wall and second side wall extend from the base wall and are connected to the base wall along opposed longitudinal side edges of the base wall; and sliding the package longitudinally relative to the opening tool along the upper support deck from the front end section to the rear end section with the base wall of the package in contact with the upper support deck, wherein said sliding engages the package with the opening tool, forming an opening in the base wall of the package and allowing the articles to be at least partially dispensed from the package through the opening into the product display area;

wherein the opening tool creates the opening by cutting a severance line proximate to and parallel with a first one of the opposed longitudinal side edges, the package after first contacting the opening tool traveling further along the upper support deck by at least a distance equal to the article diameter; and wherein the articles are dispensed through the opening when the opening is located rearward of the opening tool.

3. The dispensing system of claim 1, wherein the product display area is positioned proximate the front end section.

4. The dispensing system of claim 1, wherein the opening tool is attached to the upper support deck.

5. The dispensing system of claim 1, wherein the frame further comprises first and second laterally opposed side walls.

6. The dispensing system of claim 5, wherein the opening tool is attached to at least one of the first and the second side walls.

7. The dispensing system of claim 1, wherein the severance line is a weakened severance line, and wherein the weakened severance line is severed by the opening tool as the package is moved longitudinally along the upper support deck from the front end section to the rear end section.

8. The dispensing system of claim 7, wherein the weakened severance line at least partially defines an access door, and wherein the access door is free to pivot relative to the package when the weakened severance line is severed.

9. The dispensing system of claim 8, wherein the access door pivots toward one of the front and the rear end sections when the weakened severance line is severed.

10. The dispensing system of claim 8, wherein the frame further comprises first and second laterally opposed side walls, and wherein the access door pivots toward one of the first and the second side walls when the weakened severance line is severed.

11. The dispensing system of claim 7, wherein the package defines a severance initiation area, and wherein the weakened severance line extends proximate the severance initiation area.

12. The dispensing system of claim 1, wherein at least one article of the plurality of articles rolls along the frame to the product display area after the package is opened by the opening tool.

13. The dispensing system of claim 1, wherein the package defines a severance initiation area, and wherein the opening tool passes through the severance initiation area as the package is moved longitudinally along the upper support deck from the front end section to the rear end section.

14. The dispensing system of claim 1, wherein the plurality of articles contained in the package are arranged in at least two rows.

15. The dispensing system of claim 5, wherein the opening tool is substantially centered between the first side wall and the second side wall.

16. A system for dispensing and displaying a plurality of articles each having an article diameter from a package through an opening in a base wall of the package, the system comprising:

a package containing the plurality of articles, the package comprising:
a base wall;
a first side wall;
a second side wall; and
wherein the first side wall and second side wall extend from the base wall and are connected to the base wall along opposed longitudinal side edges of the base wall:

a frame, comprising:
longitudinally opposed front and rear end sections;
laterally opposed side walls extending between the front and rear end sections;
an upper support deck extending at least partially between the front and rear end sections, sloping downward from the front end section toward the rear end section and configured to contact the base wall of the package; and
a lower support deck at least partially defining a product display area below the upper support deck, the product display area being proximate the front end section; and an opening tool associated with the frame and arranged to automatically open the package and at least partially dispense the articles from the package through the opening in the base wall of the package and into the product display area when the package is moved longitudinally along the upper support deck from the front end section toward the rear end section;

wherein the opening tool creates the opening by cutting a severance line proximate to and parallel with a first one of the opposed longitudinal side edges, the package after first contacting the opening tool traveling further along the upper support deck by at least a distance equal to the article diameter; and wherein the articles are dispensed through the opening in the base wall of the package when the opening in the base wall of the package is located rearward of the opening tool.

17. The system of claim 1, wherein a second severance line is cut proximate to and parallel with a second one of the opposed longitudinal side edges.

18. The system of claim 1, wherein the severance line is located in one of the base wall and the first side wall.

19. The system of claim 2, wherein the severance line is located in one of the base wall and the first side wall.

20. The system of claim 16, wherein the severance line is located in one of the base wall and the first side wall.

* * * * *